US010604969B2

(12) United States Patent
Suzumura et al.

(10) Patent No.: US 10,604,969 B2
(45) Date of Patent: Mar. 31, 2020

(54) VEHICLE DOOR LOCK DEVICE

(71) Applicant: AISIN SEIKI KABUSHIKI KAISHA, Kariya-shi, Aichi (JP)

(72) Inventors: Makoto Suzumura, Chita (JP); Hodaka Matsuura, Nagoya (JP); Yasuhiko Sono, Hekinan (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 382 days.

(21) Appl. No.: 15/528,955

(22) PCT Filed: Nov. 24, 2015

(86) PCT No.: PCT/JP2015/082890

§ 371 (c)(1),
(2) Date: May 23, 2017

(87) PCT Pub. No.: WO2016/084786

PCT Pub. Date: Jun. 2, 2016

(65) Prior Publication Data

US 2017/0268264 A1 Sep. 21, 2017

(30) Foreign Application Priority Data

Nov. 25, 2014 (JP) ..... 2014-237366
Nov. 24, 2015 (JP) ..... 2015-228443

(51) Int. Cl.
*E05B 79/16* (2014.01)
*E05B 77/34* (2014.01)
(Continued)

(52) U.S. Cl.
CPC ..... *E05B 79/16* (2013.01); *E05B 77/34* (2013.01); *E05B 81/06* (2013.01); *E05B 81/16* (2013.01);
(Continued)

(58) Field of Classification Search
CPC ..... Y10T 292/1082; Y10T 292/1047; Y10T 292/1043; Y10T 70/5978; Y10T 70/7102;
(Continued)

(56) References Cited

U.S. PATENT DOCUMENTS 7,500,700 B2 * 3/2009 Kunst ..... E05B 81/14 292/201
2002/0167177 A1 * 11/2002 Erices ..... E05B 77/04 292/201
(Continued)

FOREIGN PATENT DOCUMENTS

FR 2 995 622 A1 3/2014
JP 2005-282223 A 10/2005

OTHER PUBLICATIONS

International Search Report (PCT/ISA/210) dated Feb. 23, 2016, by the Japanese Patent Office as the International Searching Authority for International Application No. PCT/JP2015/082890.
(Continued)

*Primary Examiner* — Mark A Williams
(74) *Attorney, Agent, or Firm* — Buchanan Ingersoll & Rooney PC

(57) ABSTRACT

A vehicle door lock device includes: a door switch arranged in an actuator housing to which a locking mechanism is assembled; a switch lever; and a lever pivoting amount adjusting mechanism configured to adjust a pivoting amount of the switch lever so that a ratio of the pivoting amount of the switch lever to a pivoting amount of a latch is set smaller in a second pivot state in which the latch is pivoted within a range of from a switching position to an unlatched position than in a first pivot state in which the latch is pivoted within a range of from a fully-latched position to the switching position.

10 Claims, 29 Drawing Sheets

(51) Int. Cl.

| | |
|---|---|
| ***E05B 85/02*** | (2014.01) |
| ***E05B 81/66*** | (2014.01) |
| ***E05B 81/16*** | (2014.01) |
| ***E05B 81/70*** | (2014.01) |
| ***E05B 81/06*** | (2014.01) |
| ***E05B 81/24*** | (2014.01) |
| *E05B 81/68* | (2014.01) |

(52) U.S. Cl.
CPC ..... *E05B 81/25* (2013.01); *E05B 81/66* (2013.01); *E05B 81/70* (2013.01); *E05B 85/02* (2013.01); *E05B 81/68* (2013.01)

(58) Field of Classification Search
CPC ..... E05B 81/14; E05B 81/66; E05B 81/68; E05B 85/26; E05B 81/64; E05B 77/34; E05B 85/02; B60R 16/005
See application file for complete search history.

(56) References Cited

U.S. PATENT DOCUMENTS

2005/0218662 A1 10/2005 Umino
2006/0055178 A1* 3/2006 Graute ..... E05B 85/26 292/216
2008/0203737 A1* 8/2008 Tomaszewski ..... E05B 77/26 292/216
2010/0078945 A1* 4/2010 Imatomi ..... E05B 81/20 292/216
2010/0244466 A1* 9/2010 Tomaszewski ..... E05B 77/26 292/201
2011/0127780 A1* 6/2011 Barth ..... E05B 85/243 292/213
2013/0328325 A1* 12/2013 Uehara ..... E05B 77/06 292/100

OTHER PUBLICATIONS

Written Opinion (PCT/ISA/237) dated Feb. 23, 2016, by the Japanese Patent Office as the International Searching Authority for International Application No. PCT/JP2015/082890.

* cited by examiner

VEHICLE DOOR LOCK DEVICE

TECHNICAL FIELD

The present invention relates to a vehicle door lock device to be mounted to a vehicle door.

BACKGROUND ART

Hitherto, there has been known a vehicle door lock device (hereinafter, also simply referred to as "door lock device") including a door switch configured to detect a latch position of a latch that is pivotable between a fully-latched position where the latch is engaged with a striker, and an unlatched position where the latch is disengaged from the striker. One of door lock devices of this type is disclosed in, for example, Patent Literature 1. In such a door lock device, a courtesy switch (door switch), which is actuated in accordance with the position of the latch, is configured so as to come into slide contact with a cam surface of the latch. The courtesy switch is accommodated in a latch accommodating portion (latch body) together with the latch.

CITATION LIST

Patent Literature

[PTL 1] JP 2005-282223 A

SUMMARY OF INVENTION

Technical Problem

In the door lock device disclosed in Patent Literature 1, the courtesy switch is accommodated in the latch accommodating portion (non-waterproof region) that is not waterproofed. Accordingly, in order to ensure waterproofness, it is necessary to use an expensive waterproof door switch as the courtesy switch. In this context, as measures to reduce cost required for the door lock device, it is conceivable to arrange the courtesy switch in a region of an actuator housing to which a locking mechanism is assembled. The region of the actuator housing is waterproofed because electrical components are accommodated in the actuator housing. When the above-mentioned measures are taken, a non-waterproof switch that is less expensive than a waterproof switch can be used as the courtesy switch. Thus, the cost required for the door lock device can be reduced. Meanwhile, when the courtesy switch is arranged in the actuator housing, there is a high demand for further downsizing of the entire door lock device.

The present invention has been made in view of the above-mentioned circumstances, and has an object to provide a technology effective for downsizing of a vehicle door lock device including a door switch configured to detect a position of a latch and arranged in an actuator housing to which a locking mechanism is assembled.

Solution to Problem

In order to achieve the above-mentioned object, a vehicle door lock device according to the present invention is to be mounted to a vehicle door, and includes a latch, a locking mechanism, a door switch, a switch lever, and a lever pivoting amount adjusting mechanism. The latch is configured so as to be pivotable about a latch shaft between a fully-latched position where the latch is engaged with a striker, and an unlatched position where the latch is disengaged from the striker. The locking mechanism is configured to set the latch to an unlocked state enabling disengagement from the striker, or to a locked state disabling disengagement from the striker. The door switch is arranged in an actuator housing to which the locking mechanism is assembled. The door switch is actuated in accordance with a position of the latch. The switch lever is configured so as to be pivotable about a lever shaft extending from the actuator housing in a direction intersecting the latch shaft. The switch lever is configured to pivot in interlock with the latch so that an actuation state of the door switch is switched from one of an OFF state and an ON state to the other of the OFF state and the ON state when the latch is pivoted from the fully-latched position to a switching position halfway to the unlatched position (preferably, a half-latched position), and so that the actuation state of the door switch is kept in one of the ON state and the OFF state when the latch is positioned within a range of from the switching position to the unlatched position.

The lever pivoting amount adjusting mechanism is configured to adjust a pivoting amount of the switch lever so that a ratio of the pivoting amount of the switch lever to a pivoting amount of the latch is set smaller in a second pivot state in which the latch is pivoted within the range of from the switching position to the unlatched position than in a first pivot state in which the latch is pivoted within a range of from the fully-latched position to the switching position. In short, according to the lever pivoting amount adjusting mechanism, when the latch is shifted from the first pivot state to the second pivot state, the pivoting amount of the switch lever configured to pivot in interlock with the latch can be set smaller than the pivoting amount of the switch lever prior to the shift. Therefore, after the latch is pivoted from the fully-latched position to the switching position so that the actuation state of the door switch is switched from the OFF state to the ON state, even when the latch is further pivoted toward the unlatched position, the switch lever can be prevented from pivoting more than necessary. In this case, after the actuation state of the door switch is switched to the ON state, it is not necessary to excessively pivot the switch lever by an amount equal to the pivoting amount before the actuation state of the door switch is switched to the ON state. Accordingly, increase in size of the structure for pivoting the switch lever can be prevented. As a result, the vehicle door lock device can be downsized. Further, the door switch is arranged in the region of the actuator housing that is waterproofed. Thus, a non-waterproof switch that is less expensive than a waterproof switch can be used as the door switch.

In the vehicle door lock device having the above-mentioned configuration, it is preferred that the switch lever include an engagement arm configured to press the latch toward the fully-latched position, and that the engagement arm be elastically biased by a lever spring in a direction of pressing the latch toward the fully-latched position. In this case, it is preferred that the lever pivoting amount adjusting mechanism include a first engagement surface and a second engagement surface. The first engagement surface is formed on the latch so as to keep the ratio of the pivoting amount of the switch lever to the pivoting amount of the latch when an arm distal end portion of the engagement arm slides on the latch in the first pivot state against an elastic biasing force of the lever spring. The second engagement surface is formed on the latch so as to set the ratio of the pivoting amount of the switch lever to the pivoting amount of the latch to be smaller than the ratio in the first pivot state when the arm distal end portion slides on the latch in the second pivot state against the elastic biasing force of the lever spring. With this configuration, without increase in the number of components, the lever pivoting amount adjusting mechanism can be constructed through use of the first engagement surface and the second engagement surface formed on the latch being the existing component. Thus, increase in product cost of the door lock device can be prevented.

Further, the switch lever may extend toward the latch from a boss portion that is to be mounted to the lever shaft.

In the vehicle door lock device having the above-mentioned configuration, it is preferred that the first engagement surface of the lever pivoting amount adjusting mechanism be formed of a latch outer peripheral cam surface of the latch, and that the second engagement surface of the lever pivoting amount adjusting mechanism be formed of one of both latch side surfaces, which extend along a pivoting plane of the latch, closer to the lever shaft. In this case, among portions of the latch, one of the side surfaces of the latch, which is used as the second engagement surface, is in a positional relationship of being opposed to the arm distal end portion of the engagement arm. As compared to a case where the outer peripheral cam surface of the latch (outer peripheral surface continuous with the first engagement surface) is used as the second engagement surface, increase in contour of the latch can be prevented.

The vehicle door lock device may further include a latch housing having a support wall, which is configured to support the latch so as to enable the latch to pivot and has a through-hole formed therein, in which the latch is biased to move to the unlatched position side, in which the switch lever passes through the through-hole in a relatively movable manner, and in which, when the latch is positioned at the unlatched position, the latch overlaps at least a part of the through-hole as seen from a thickness direction of the support wall.

The vehicle door lock device may further include a latch housing having a support wall, which is configured to support the latch so as to enable the latch to pivot and has a through-hole formed therein, in which the latch is biased to move to the unlatched position side, in which the switch lever passes through the through-hole in a relatively movable manner, and in which, when the latch is positioned at the unlatched position, the switch lever overlaps at least a part of the through-hole as seen from a thickness direction of the support wall.

The switch lever positioned between the support wall and the door switch may press the door switch.

The actuator housing may include an inner wall, which is positioned between the through-hole and the door switch and has a switch lever movement allowing groove formed therein, in which the switch lever is arranged in the switch lever movement allowing groove in a relatively movable manner, and in which the switch lever overlaps at least a part of the switch lever movement allowing groove as seen from a thickness direction of the inner wall.

The actuator housing may include a switch-side waterproof wall positioned between the through-hole and the door switch.

The latch housing may have a striker entry groove and a communication hole formed therein, in which the striker entry groove receives the striker when the vehicle door is closed and the communication hole allows the striker entry groove and an internal space of the housing to communicate with each other, in which the latch opens a part of the communication hole when the latch is positioned at the unlatched position, and in which the latch housing includes a latch-side waterproof wall located between the part of the communication hole and the through-hole.

The housing may have a striker entry groove that is formed therein and communicates with an internal space of the housing, in which the striker entry groove receives the striker when the vehicle door is closed, and in which the door switch may be arranged in a region of the internal space of the housing above the striker entry groove.

Advantageous Effects of Invention

As described above, according to the present invention, it is possible to downsize the vehicle door lock device including the door switch configured to detect the position of the latch and arranged in the actuator housing to which the locking mechanism is assembled.

DESCRIPTION OF EMBODIMENTS

Figure 1:
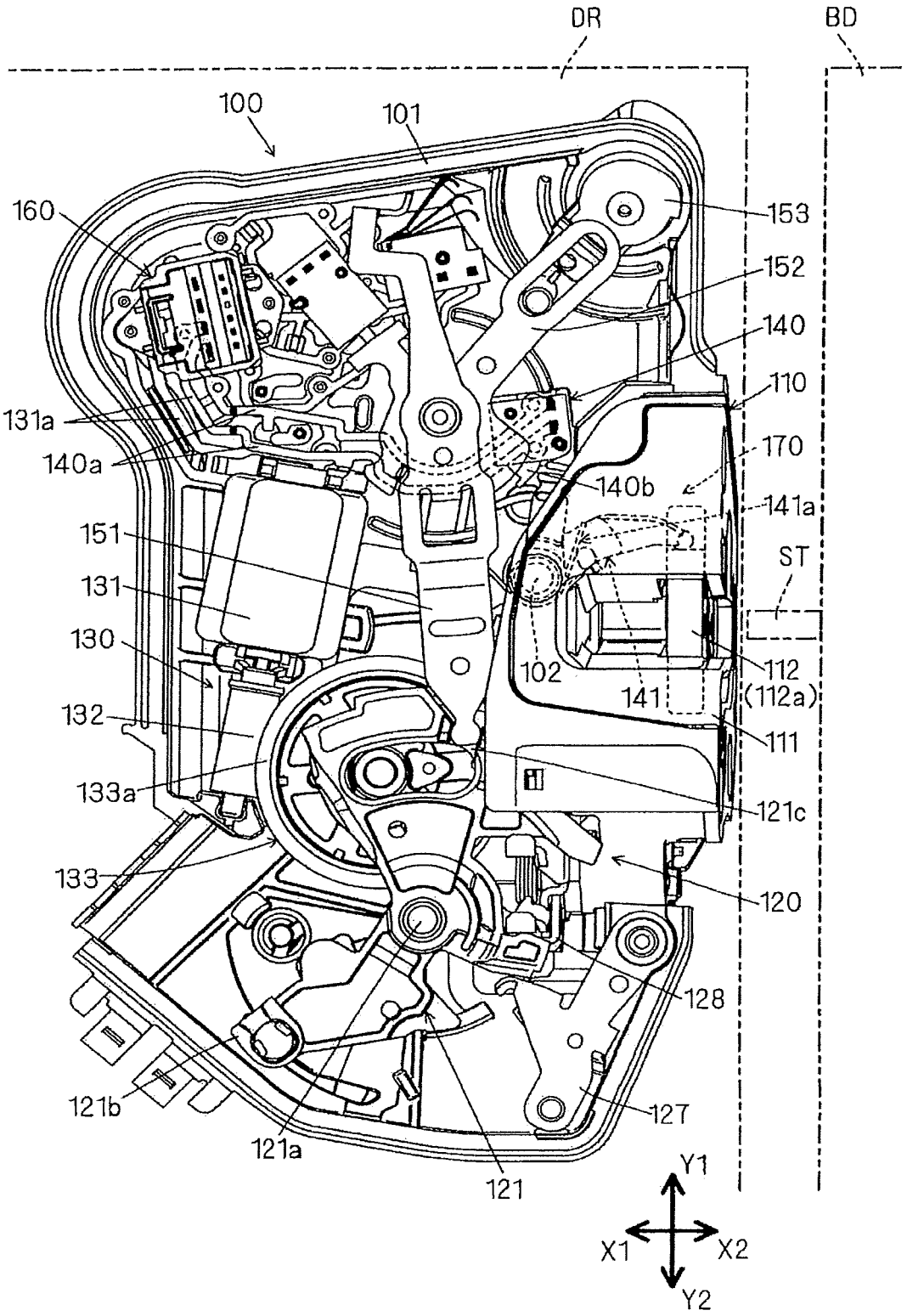
FIG. 1 is a view for illustrating an internal structure of a vehicle door lock device 100 according to a first embodiment of the present invention.

Now, a first embodiment of the present invention is described with reference to the drawings. In the drawings, a vehicle frontward direction and a vehicle rearward direction are indicated by the arrow X1 and the arrow X2, respectively. A vehicle upward direction and a vehicle downward direction are indicated by the arrow Y1 and the arrow Y2, respectively. Further, a vehicle leftward direction and a vehicle rightward direction are indicated by the arrow Z1 and the arrow Z2, respectively. Those directions respectively correspond to directions of both a vehicle door lock device which has not been mounted to a vehicle door and a vehicle door lock device which has been mounted to a vehicle door. Further, in this specification, an action of pivoting about a predetermined axis is represented by a term "pivot". However, in place of this term, a term "rotate" or a term "swing" may also be used.

A vehicle door lock device (hereinafter, also simply referred to as "door lock device") 100 according to the first embodiment illustrated in FIG. 1 is mounted in a region defined by a door outer panel (vehicle outside panel) and a door inner panel (vehicle inside panel) of a vehicle door DR. In FIG. 1, a right vehicle door for a front seat is illustrated as a typical example of the vehicle door DR.

The door lock device 100 includes an actuator housing 101 made of resin. The actuator housing 101 includes a flat plate portion having a flat plate shape and extending along the vehicle frontward direction X1 and the vehicle rearward direction X2. A component such as a locking mechanism 120 is assembled to the flat plate portion.

As is well known, a latch mechanism 110 is configured to keep the vehicle door DR in a closed state with respect to a vehicle body BD. The latch mechanism 110 includes a latch body 111 made of resin and fixed to the actuator housing 101, and a latch 112 capable of engaging with and disengaging from a striker ST fixed to the vehicle body BD. The latch body 111 has a flat plate shape and extends along a direction intersecting the flat plate portion of the actuator housing 101 (vehicle leftward and rightward direction). The latch 112 is pivotably supported by a latch shaft 112*a* formed on the latch body 111, and is rotatable so as to be both meshed with and unmeshed from the striker ST. In this case, the latch shaft 112*a* for the latch 112 extends in the vehicle frontward direction X1 and the vehicle rearward direction X2. The latch 112 can be positioned at a plurality of positions including a fully-latched position where the latch 112 is engaged with the striker ST, an unlatched position where the latch 112 is disengaged from the striker ST, and a half-latched position between the unlatched position and the fully-latched position. The latch 112 is configured so as to be pivotable about the latch shaft 112*a* between the fully-latched position and the unlatched position. The latch 112 is engaged with the striker ST at the fully-latched position and then kept engaged so that the vehicle door DR is held in a closed state (latched state). Meanwhile, the latch 112 and the striker ST are disengaged from each other so that the striker ST is separated from the latch 112 at the unlatched position. Thus, the vehicle door DR is shifted from the closed state to an opened state (unlatched state). The latch 112 corresponds to a "latch" according to the present invention.

In order to control an interior light and the like in accordance with an opened or closed condition of the vehicle door DR, a door switch (also referred to as "courtesy switch") 140 configured to detect a latch position of the latch 112 is provided so as to correspond to the latch 112. The door switch 140 corresponds to a "door switch" according to the present invention. The door switch 140 is arranged in the actuator housing 101. The door switch 140 is connected to a power-supply external terminal via a pair of door switch terminals 140*a* and 140*a* made of metal in a connector 160 made of resin. The door switch 140 detects whether or not the latch 112 is positioned at the fully-latched position.

In the first embodiment, a region of the actuator housing 101, to which the door switch terminals 140*a* and 140*a* and electrical components such as the connector 160 are assembled, is designed as a waterproofed region. Accordingly, when the door switch 140 is arranged in the actuator housing 101, a non-waterproof switch that is less expensive than a waterproof switch can be used as the door switch 140. Further, wires extending from the door switch 140 are collected in the connector 160 through intermediation of the door switch terminals 140*a* and 140*a*. Thus, the wires are connected to wires of the vehicle by one easy operation.

A switch lever 141 is interposed between the latch 112 and the door switch 140 so as to be engaged with both the latch 112 and the door switch 140. The switch lever 141 is configured so as to be pivotable about a lever shaft 102 extending from the actuator housing 101, and is elastically biased by a lever spring 141*a* in a clockwise direction in FIG. 1. In this case, the lever shaft 102 for the switch lever 141 extends from the actuator housing 101 in the vehicle leftward and rightward directions orthogonal to the latch shaft 112*a* for the latch 112. The switch lever 141 is configured so as to be engaged with an engagement projection 140*b* configured to switch an actuation state of the door switch 140 between an OFF state and an ON state.

The locking mechanism 120 carries out a function of setting the latch 112 of the latch mechanism 110 to an unlocked state enabling disengagement from the striker ST, or a locked state disabling disengagement from the striker ST. The locking mechanism 120 includes an active lever 121, an inside open lever 122, an outside open lever 123, and an actuator 130. The locking mechanism 120 corresponds to a "locking mechanism" according to the present invention.

The active lever 121 is configured to pivot about a lever support shaft 121*a*, which is formed on the actuator housing 101, between an unlocking position of setting an open link (not shown) to an unlocked position (first position), and a locking position of setting the open link to a locked position (second position). Further, the open link is configured to be actuated between the unlocked position and the locked position through operation of the inside open lever 122 or the outside open lever 123. When the open link is set to the unlocked position under a state in which the vehicle door DR is closed, the latch mechanism 110 is shifted from the latched state to the unlatched state through door opening operation of a door handle. Thus, the vehicle door DR is unlocked. Meanwhile, when the open link is set to the locked position under a state in which the vehicle door DR is closed, the latch mechanism 110 is held in the latched state even through the door opening operation of the door handle. Thus, the vehicle door DR is prevented from being unlocked.

The active lever 121 is configured to pivot (or "swing" or "rotate") between the unlocking position and the locking position through operation of a locking and unlocking operation member. Examples of the locking and unlocking operation member include a lock knob (not shown) arranged inside the vehicle door DR, a key cylinder (not shown) capable of being operated from an outer side of the vehicle door DR, and a remote controller (not shown) configured to actuate the actuator 130. Specifically, an operation portion 121*b* of the active lever 121 is coupled to the lock knob through an operation cable (not shown). An engagement portion 121*c* of the active lever 121 is linked with the key cylinder through a locking control lever 151, a key switch lever 152, an outside locking lever 153, and the like.

The actuator 130 includes an electric motor 131 actuated through operation of a remote controller being one of locking and unlocking operation members, a worm gear 132 mounted on a motor shaft of the electric motor 131, and an annular wheel gear 133 that is engaged with the active lever 121 and has gear teeth 133*a* to be engaged with the worm gear 132. A pair of motor terminals 131*a* and 131*a*, which are made of metal, of the electric motor 131 are connected to a power-supply external terminal through intermediation of the connector 160 made of resin. Accordingly, a driving force of the electric motor 131 is transmitted to the wheel gear 133 through intermediation of the worm gear 132 and the gear teeth 133*a*, and the wheel gear 133 is rotated about a center thereof. Thus, the active lever 121 is pivoted.

Next, with reference to FIG. 2 to FIG. 9, detailed description is made of a latch interlocking unit 170 configured to actuate the door switch 140 and the switch lever 141 having the above-mentioned configuration in interlock with the latch 112.

Figure 2:
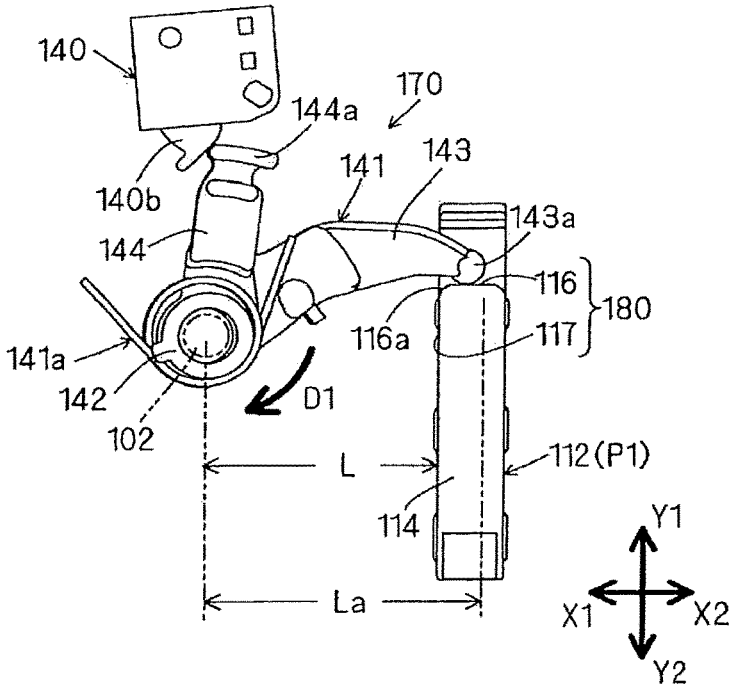
FIG. 2 is a view for illustrating a latch interlocking unit 170 of FIG. 1 as seen from an inner side of a vehicle under a state in which a latch 112 is positioned at a fully-latched position.
Figure 3:
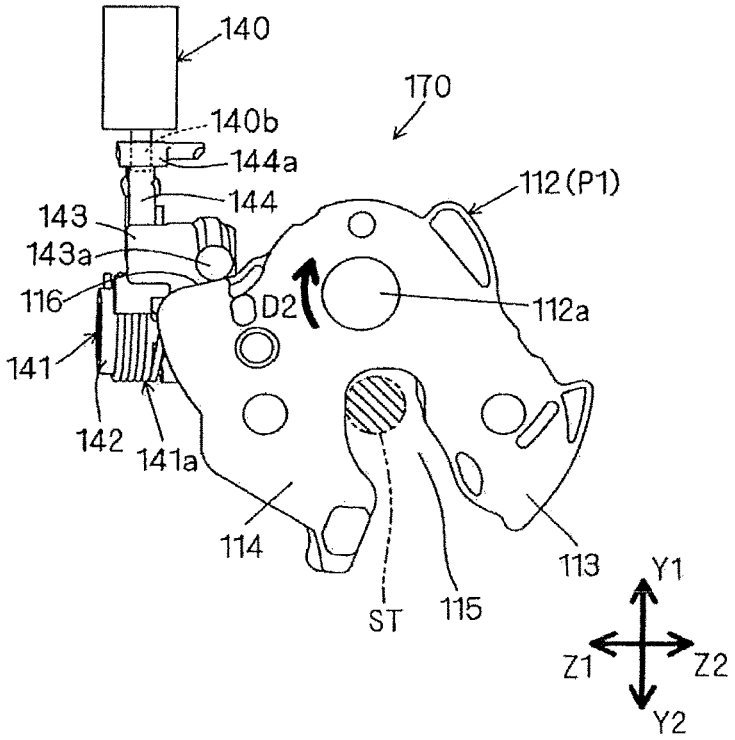
FIG. 3 is a view for illustrating the latch interlocking unit 170 of FIG. 2 as seen from a rear side of the vehicle.

As illustrated in FIG. 2 and FIG. 3, the latch 112 has a flat plate shape and extends on a plane defined by two directions, that is, the vehicle upward and downward directions indicated by the arrows Y1 and Y2 and the vehicle leftward and rightward directions indicated by the arrows Z1 and Z2, and includes a first locking claw 113 and a second locking claw 114 extending substantially in parallel to each other. In the latch 112, a region defined between the locking claws 113 and 114 opposed to each other is formed as a striker receiving portion 115 configured to receive the striker ST. It is preferred that the latch 112 have a configuration of being formed by coating a surface of a metal material with a resin material.

Meanwhile, the switch lever 141 includes a first engagement arm 143 extending toward the latch 112 from a cylindrical boss portion 142 mounted on the lever shaft 102, and a second engagement arm 144 extending from the boss portion 142 toward the door switch 140. The switch lever 141 is configured such that, under a state in which the switch lever 141 is always elastically biased in the direction indicated by the arrow D1 by the lever spring 141*a* being a coil spring member, an arm distal end portion 143*a* of the first engagement arm 143 is engaged with the latch 112, and an arm distal end portion 144*a* of the second engagement arm 144 is engaged with the engagement projection 140*b* of the door switch 140. In other words, the first engagement arm 143 of the switch lever 141 presses the latch 112 toward a fully-latched position P1, and the switch lever 141 is elastically biased by the lever spring 141*a* in a direction of pressing the latch 112 toward the fully-latched position P1 (direction indicated by the arrow D1) by the first engagement arm 143. The switch lever 141 and the first engagement arm 143 correspond to a "switch lever" and an "engagement arm" according to the present invention, respectively. Further, the lever spring 141*a* corresponds to a "lever spring" according to the present invention.

It is preferred that a surface, which is to be engaged with an engagement object, of at least one of the arm distal end portion 143*a* of the first engagement arm 143 and the arm distal end portion 144*a* of the second engagement arm 144 be formed into a curved surface so as to be smoothly slidable on the engagement object.

The latch 112 includes a first engagement surface 116 and a second engagement surface 117 that are both to be used for engagement with the first engagement arm 143 of the switch lever 141. The first engagement surface 116 is formed of a latch outer peripheral cam surface, which is a part of an outer peripheral surface of the latch 112 defining a latch contour and is opposite to the striker receiving portion 115 with respect to the latch shaft 112*a*. In contrast, the second engagement surface 117 is formed of one of both latch side surfaces, which extend along a pivoting plane of the latch 112, closer to the lever shaft 102. The first engagement surface 116 and the second engagement surface 117 described above correspond to a "first engagement surface" and a "second engagement surface" according to the present invention.

When the latch 112 is positioned at the fully-latched position P1 as illustrated in FIG. 2 and FIG. 3, the latch 112 is engaged with a pole (not shown) and thus positioned at the fully-latched position P1. Accordingly, the latch 112 is restrained from rotating about the latch shaft 112*a* in a clockwise direction (direction indicated by the arrow D2 in FIG. 3). In other words, at the fully-latched position P1, the latch 112 is restrained from rotating in a direction of unlocking the latch 112 (direction of unlatching). As a result, the vehicle door DR is held in a fully-closed state. Further, when the latch 112 is positioned at the fully-latched position P1, La represents a horizontal distance of the first engagement arm 143 of the switch lever 141 in the vehicle frontward and rearward directions indicated by the arrows X1 and X2, that is, a distance from the lever shaft 102 to the arm distal end portion 143*a* when the first engagement arm 143 is projected onto a horizontal plane. The horizontal distance La is larger than an interval L in the vehicle frontward and rearward directions indicated by the arrows X1 and X2 between the lever shaft 102 and the second engagement surface 117 that is one side surface (latch back surface) opposed to the switch lever 141 in the both side surfaces of the latch 112. Therefore, the arm distal end portion 143*a* of the first engagement arm 143 of the switch lever 141 is brought into abutment against the first engagement surface 116 of the latch 112 from above by an elastic biasing force of the lever spring 141*a*. Further, the arm distal end portion 144*a* of the second engagement arm 144 of the switch lever 141 does not press the engagement projection 140*b* of the door switch 140 from an OFF position to an ON position. Thus, when the latch 112 is positioned at the fully-latched position P1, the actuation state of the door switch 140 is not switched to the ON state.

Figure 4:
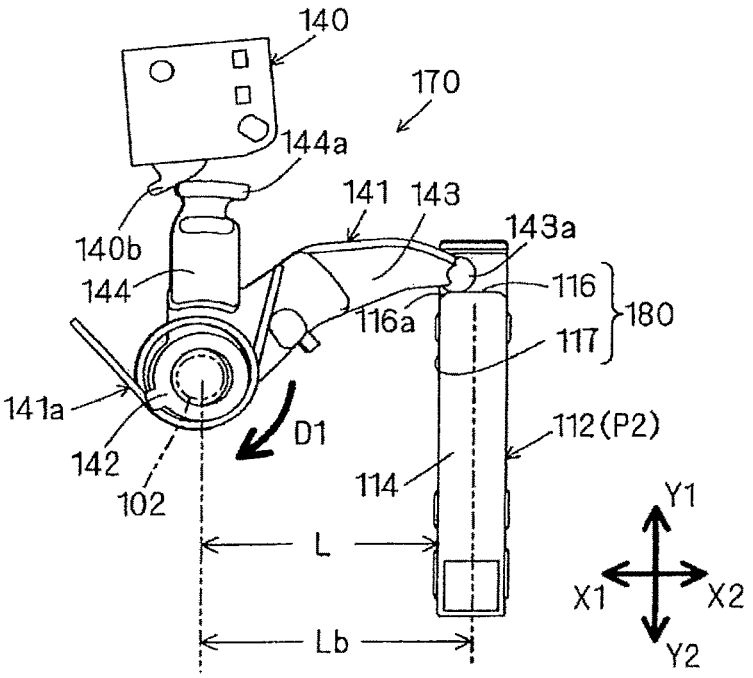
FIG. 4 is a view for illustrating the latch interlocking unit 170 of FIG. 1 as seen from the inner side of the vehicle under a state in which the latch 112 is positioned at a switching position P2.
Figure 5:
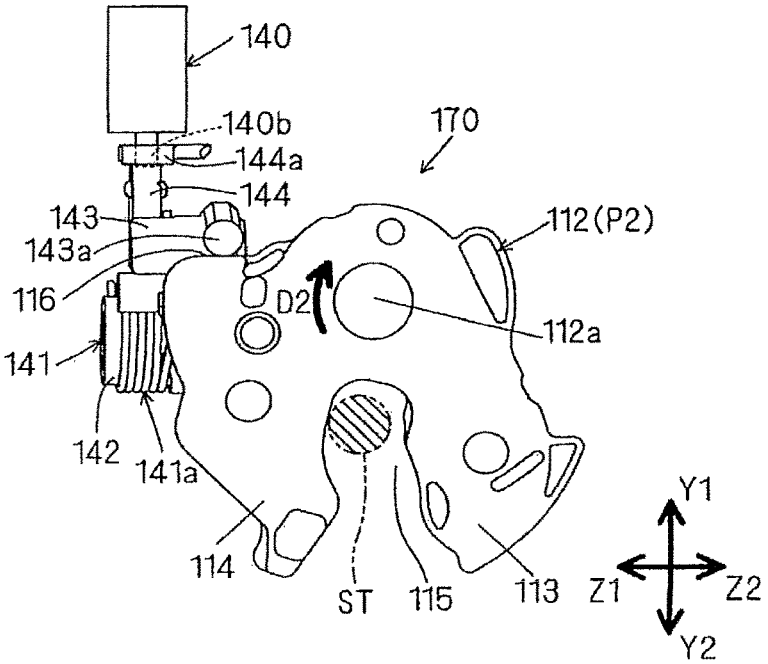
FIG. 5 is a view for illustrating the latch interlocking unit 170 of FIG. 4 as seen from the rear side of the vehicle.

After that, the latch 112 is pivoted about the latch shaft 112*a* from the fully-latched position P1 toward an unlatched position (also referred to as "latch releasing position" or "latch opening position") P4 (that is, a half-latched position P3). At this time, the arm distal end portion 143*a* of the first engagement arm 143 of the switch lever 141 is pushed up by the first engagement surface 116 of the latch 112. Thus, against the elastic biasing force of the lever spring 141*a*, the switch lever 141 is pivoted about the lever shaft 102 in a direction opposite to the direction indicated by the arrow D1 in FIG. 4. As illustrated in FIG. 4 and FIG. 5, when the latch 112 is pivoted to a switching position (switch-on position) P2 halfway to the unlatched position P4 (that is, the half-latched position P3), the switch lever 141 is pivoted in interlock with the latch 112 so as to switch the actuation state of the door switch 140 from the OFF state to the ON state. That is, the arm distal end portion 144*a* of the second engagement arm 144 of the switch lever 141 presses the engagement projection 140*b* of the door switch 140 from the OFF position to the ON position. Thus, the actuation state of the door switch 140 is switched to the ON state. As a result, for example, the interior light is turned on. In this case, the switching position P2 is set between the fully-latched position P1 and the half-latched position P3. Further, a horizontal distance Lb of the switch lever 141 at this time is smaller than the above-mentioned horizontal distance La, but larger than the interval L. Therefore, the arm distal end portion 143*a* of the first engagement arm 143 slides on the first engagement surface 116 of the latch 112 in the vehicle frontward direction X1.

Figure 6:
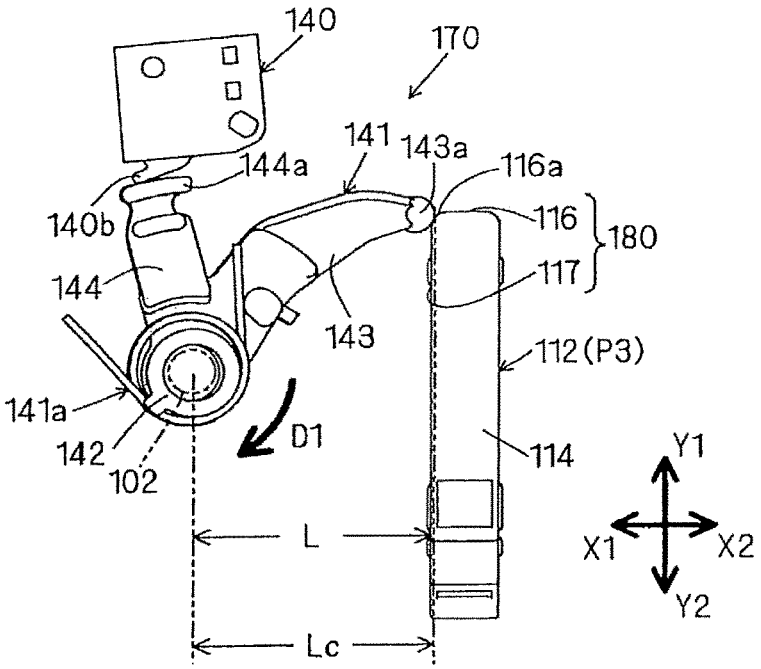
FIG. 6 is a view for illustrating the latch interlocking unit 170 of FIG. 1 as seen from the inner side of the vehicle under a state in which the latch 112 is positioned at a half-latched position P3.
Figure 7:
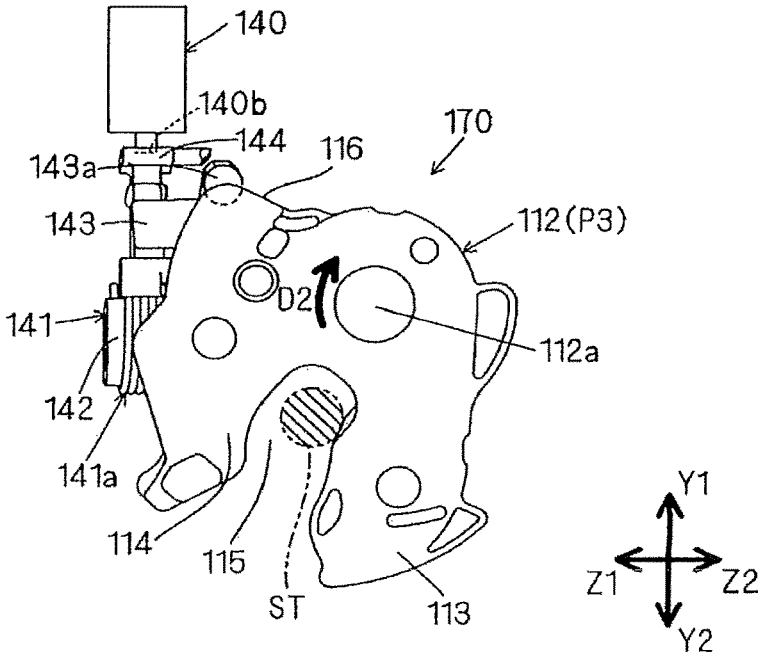
FIG. 7 is a view for illustrating the latch interlocking unit 170 of FIG. 6 as seen from the rear side of the vehicle.

As illustrated in FIG. 6 and FIG. 7, when the latch 112 is further pivoted about the latch shaft 112*a* from the switching position P2 to the half-latched position P3 toward the unlatched position P4, the arm distal end portion 143*a* of the first engagement arm 143 of the switch lever 141 is pushed up by the first engagement surface 116 of the latch 112, and the switch lever 141 is pivoted about the lever shaft 102 in a direction opposite to the direction indicated by the arrow D1 in FIG. 6 against the elastic biasing force of the lever spring 141*a*. As a result, the arm distal end portion 144*a* of the second engagement arm 144 of the switch lever 141 is brought into slide contact with the engagement projection 140*b* of the door switch 140. Thus, the actuation state of the door switch 140 is kept in the ON state. Further, a horizontal distance Lc of the switch lever 141 at this time is slightly larger than the interval L. Therefore, the arm distal end portion 143*a* of the first engagement arm 143 is moved from the first engagement surface 116 of the latch 112 to a corner portion 116*a*, that is, a boundary portion between the first engagement surface 116 and the second engagement surface 117.

Figure 8:
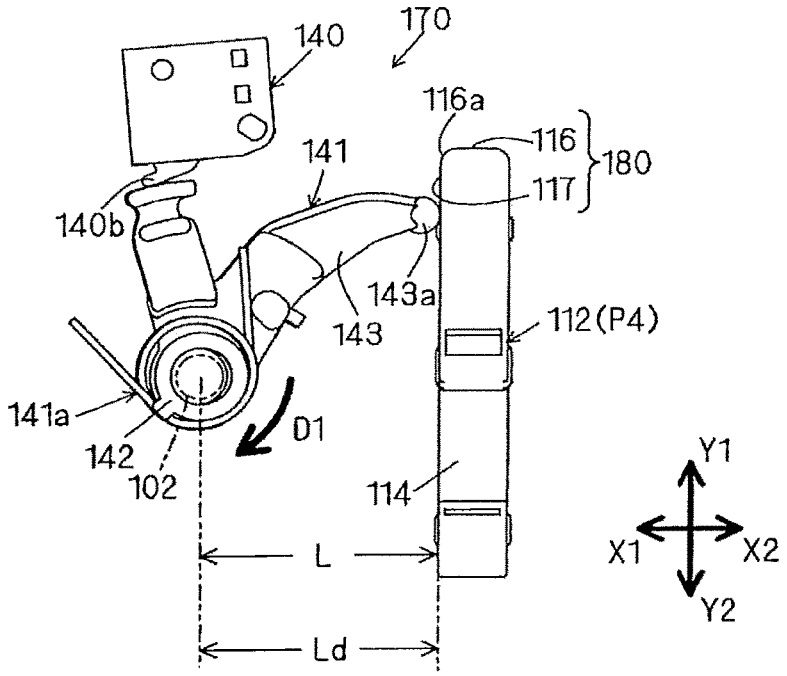
FIG. 8 is a view for illustrating the latch interlocking unit 170 of FIG. 1 as seen from the inner side of the vehicle under a state in which the latch 112 is positioned at an unlatched position P4.
Figure 9:
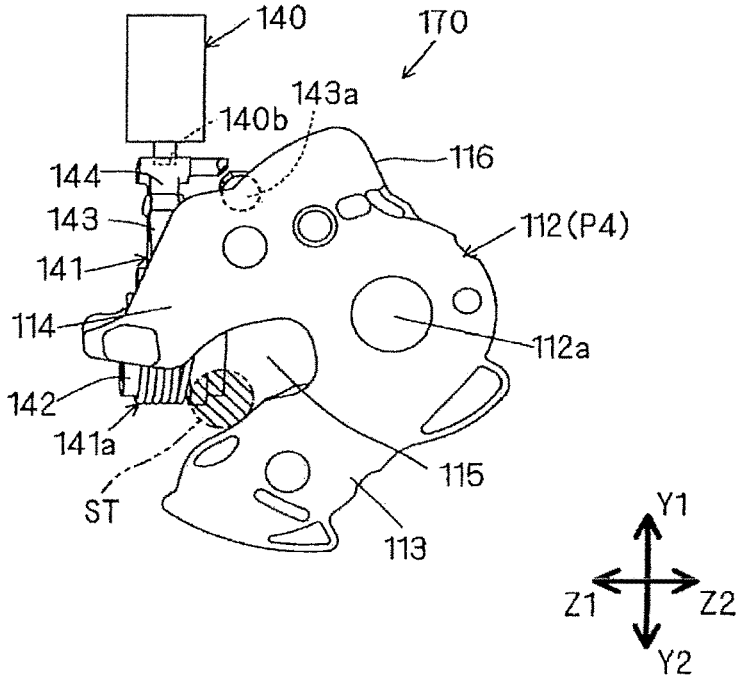
FIG. 9 is a view for illustrating the latch interlocking unit 170 of FIG. 8 as seen from the rear side of the vehicle.

As illustrated in FIG. 8 and FIG. 9, when the latch 112 is further pivoted about the latch shaft 112*a* from the half-latched position P3 to the unlatched position P4, a horizontal distance Ld of the switch lever 141 is slightly smaller than the above-mentioned horizontal distance Lc and almost equal to the interval L. In this case, a portion of the latch 112 to be engaged with the arm distal end portion 143*a* of the first engagement arm 143 of the switch lever 141 is switched from the first engagement surface 116 to the second engagement surface 117, and the arm distal end portion 143*a* of the first engagement arm 143 slides on the second engagement surface 117. That is, a pivoting position of the switch lever 141 itself is hardly shifted, and only a relative position of the latch 112 to the switch lever 141 is shifted. As a result, the actuation state of the door switch 140 is kept in the ON state. In short, when the latch 112 is positioned within a range of from the switching position P2 to the unlatched position P4, the switch lever 141 is pivoted in interlock with the latch 112 so as to keep the actuation state of the door switch 140 in the ON state. Further, the arm distal end portion 143*a* of the first engagement arm 143 is shifted to a state of sliding on the second engagement surface 117. With this configuration, increase in elastic biasing force of the lever spring 141*a* applied to the latch 112 can be prevented.

According to the latch interlocking unit 170 having the above-mentioned configuration, when the latch 112 is pivoted to a halfway position (switching position P2 or half-latched position P3) from the fully-latched position P1 halfway to the unlatched position P4, the region of the latch 112 to be engaged with the arm distal end portion 143*a* of the first engagement arm 143 of the switch lever 141 is shifted from the first engagement surface 116 to the second engagement surface 117.

Accordingly, a ratio of a pivoting amount of the switch lever 141 to a pivoting amount of the latch 112 is smaller in a second pivot state in which the latch 112 is pivoted within a range of from the switching position P2 to the unlatched position P4 than in a first pivot state in which the latch 112 is pivoted within a range of from the fully-latched position P1 to the switching position P2. In order to attain this object, the first engagement surface 116 and the second engagement surface 117 of the latch 112 constitute a lever pivoting amount adjusting mechanism 180 configured to adjust the pivoting amount of the switch lever 141. The lever pivoting amount adjusting mechanism 180 corresponds to a "lever pivoting amount adjusting mechanism" according to the present invention.

The first engagement surface 116 is formed on the latch 112 so as to keep the ratio of the pivoting amount of the switch lever 141 to the pivoting amount of the latch 112 when the arm distal end portion 143*a* of the first engagement arm 143 slides on the latch 112 in the first pivot state against the elastic biasing force of the lever spring 141*a*. Meanwhile, the second engagement surface 117 is formed on the latch 112 so as to set the ratio of the pivoting amount of the switch lever 141 to the pivoting amount of the latch 112 to be smaller the ratio in the first pivot state when the arm distal end portion 143*a* of the first engagement arm 143 slides on the latch 112 in the second pivot state against the elastic biasing force of the lever spring 141*a*.

According to the lever pivoting amount adjusting mechanism 180, when the latch 112 is shifted from the first pivot state to the second pivot state, the pivoting amount of the switch lever 141 pivoted in interlock with the latch 112 can be set smaller than the pivoting amount of the switch lever 141 before shifting to the second pivot state. Therefore, after the latch 112 is pivoted from the fully-latched position P1 to the switching position P2 so that the actuation state of the door switch 140 is switched from the OFF state to the ON state, even when the latch 112 is further pivoted toward the unlatched position P4, the switch lever 141 can be prevented from pivoting more than necessary. In this case, after the actuation state of the door switch 140 is switched to the ON state, it is not necessary to excessively pivot the switch lever 141 by an amount equal to the pivoting amount before the actuation state of the door switch 140 is switched to the ON state. Accordingly, increase in size of a structure for pivoting the switch lever 141 can be prevented. As a result, the vehicle door lock device 100 can be downsized. In short, when there is employed a structure for keeping the ratio of the pivoting amount of the switch lever 141 to the pivoting amount of the latch 112 while the latch 112 is pivoted from the fully-latched position P1 to the unlatched position P4, the switch lever 141 is excessively pivoted from the switching position P2 to the unlatched position P4. In contrast, according to the first embodiment, the structure for pivoting the switch lever 141 from the switching position P2 to the unlatched position P4 by a large amount is not required.

Further, according to the first embodiment, without increase in the number of components, the lever pivoting amount adjusting mechanism 180 can be constructed through use of the first engagement surface 116 and the second engagement surface 117 formed on the latch 112 being the existing component. Thus, increase in product cost of the door lock device 100 can be prevented. In particular, among portions of the latch 112, one of the side surfaces of the latch, which is used as the second engagement surface 117, is in an opposed positional relationship with the arm distal end portion 143*a* of the first engagement arm 143. As compared to a case where the outer peripheral cam surface of the latch (outer peripheral surface continuous with the first engagement surface) is used as the second engagement surface 117, increase in contour of the latch 112 can be prevented.

It is preferred to adopt such a configuration that, when the latch 112 is in the second pivot state, the switch lever 141 is slightly pivoted, or the pivoting amount of the switch lever 141 is set to zero, that is, the switch lever 141 is not pivoted in the least. In a case of this configuration, at a position where the actuation state of the door switch 140 is switched to the ON state, the switch lever 141 needs to be restrained from pivoting along with pivot of the latch 112 toward the unlatched position P4. However, it is not necessary to use a newly added member, such as a stopper, as restraining means for restraining pivot of the switch lever 141. Thus, increase in number of components can be prevented.

Figure 10:
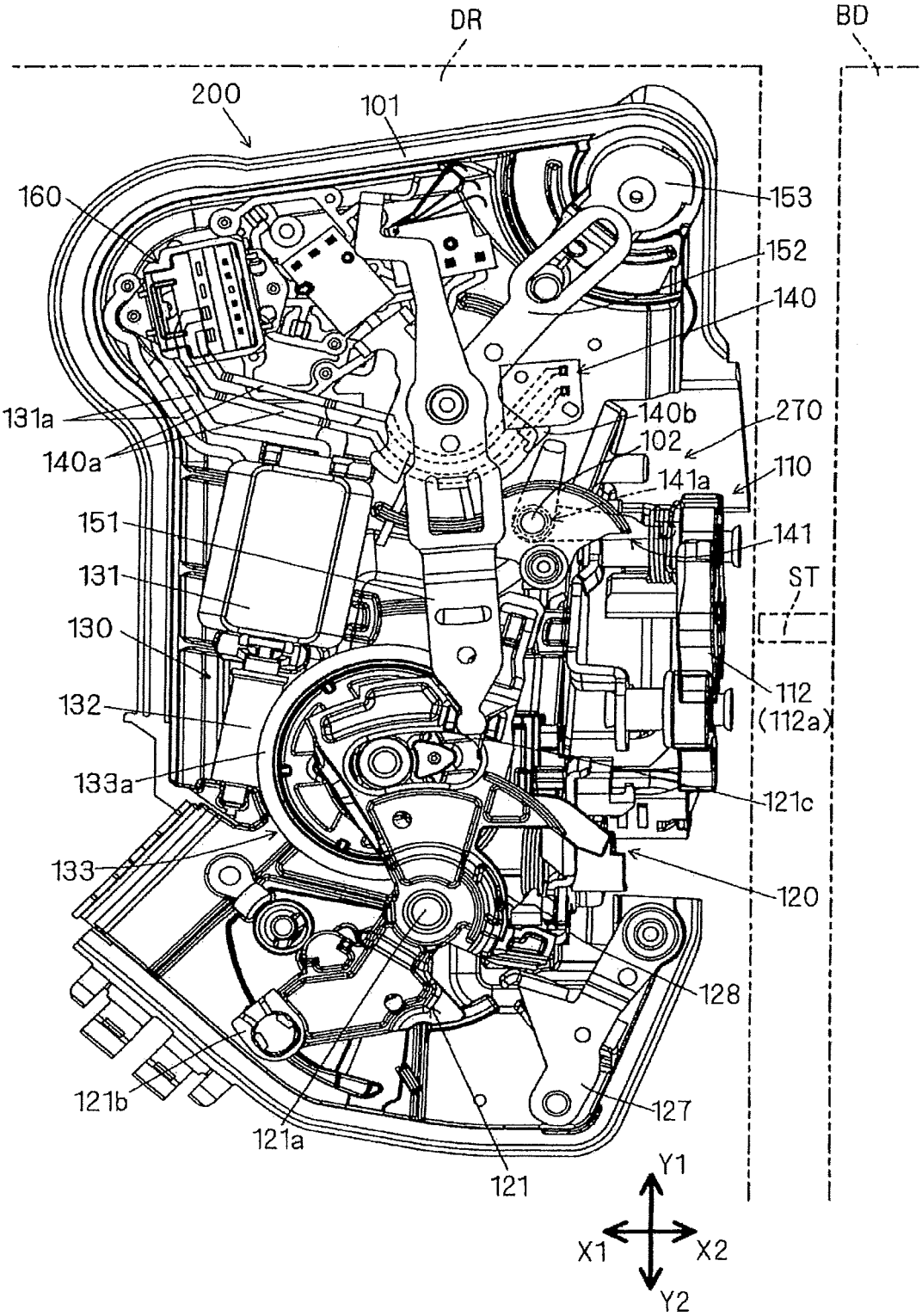
FIG. 10 is a view for illustrating an internal structure of a vehicle door lock device 200 according to a second embodiment of the present invention.

According to the present invention, a member such as a stopper may be used as appropriate as the restraining means for restraining pivot of the switch lever 141. In this case, in place of the above-mentioned door lock device 100, a door lock device 200 according to a second embodiment of the present invention as illustrated in FIG. 10 may be adopted. The door lock device 200 is substantially different from the door lock device 100 only in a structure of a latch interlocking unit 270 and a structure of a lever pivoting amount adjusting mechanism 280. Therefore, in the following, with reference to FIG. 11 to FIG. 18, only the structure of the latch interlocking unit 270 and the structure of the lever pivoting amount adjusting mechanism 280 are described in detail, and description of other components is omitted.

Figure 11:
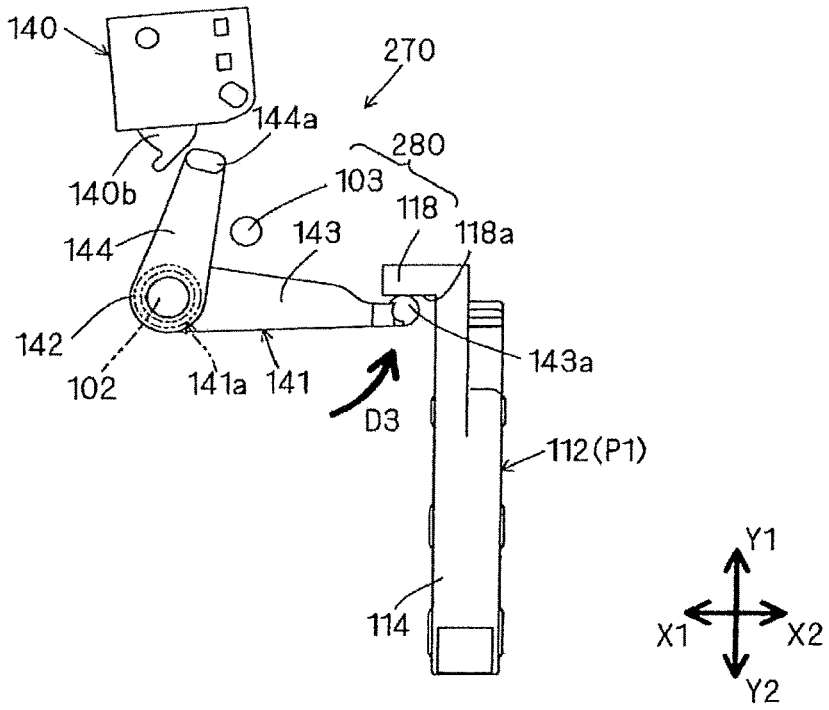
FIG. 11 is a view for illustrating a latch interlocking unit 270 of FIG. 10 as seen from the inner side of the vehicle under a state in which the latch 112 is positioned at the fully-latched position P1.
Figure 12:
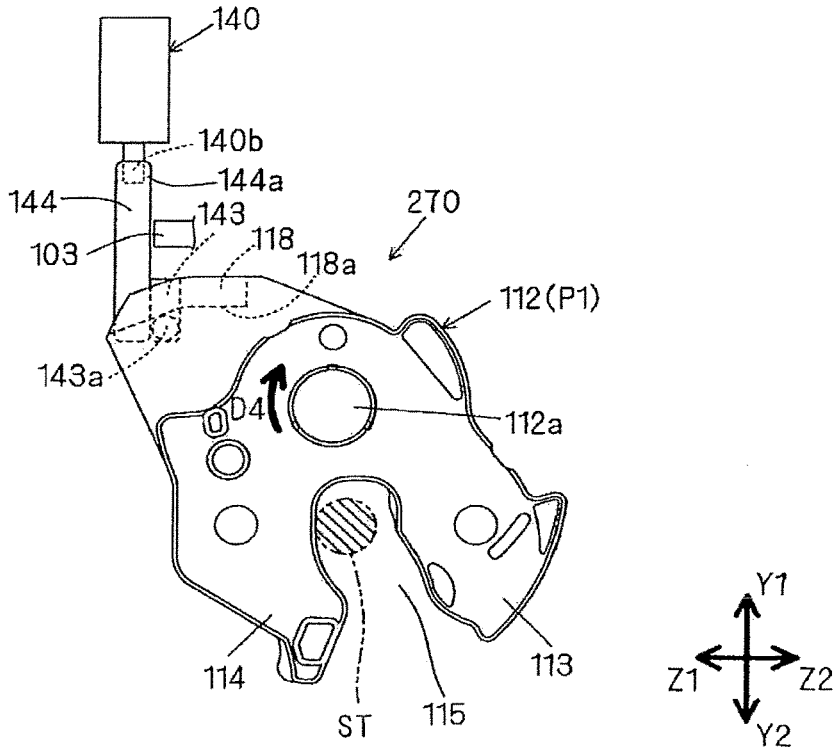
FIG. 12 is a view for illustrating the latch interlocking unit 270 of FIG. 11 as seen from the rear side of the vehicle.

As illustrated in FIG. 11 and FIG. 12, the latch interlocking unit 270 carries out a function of actuating the door switch 140 and the switch lever 141 having the above-mentioned configuration in interlock with the latch 112. The latch 112 includes a latch extended portion 118 extended from a body of the latch in the vehicle frontward direction X1. A lower surface 118*a* of the latch extended portion 118 on the latch shaft 112*a* side is formed as an engagement surface with which the arm distal end portion 143*a* of the first engagement arm 143 of the switch lever 141 is to be engaged.

The switch lever 141 is configured such that, under a state in which the switch lever 141 is always elastically biased in the direction indicated by the arrow D3 by the lever spring 141*a*, the arm distal end portion 143*a* of the first engagement arm 143 is engaged with the latch 112, and the arm distal end portion 144*a* of the second engagement arm 144 is engaged with the engagement projection 140*b* of the door switch 140. In other words, the first engagement arm 143 of the switch lever 141 presses the latch 112 toward the unlatched position P4, and the switch lever 141 is elastically biased by the lever spring 141*a* in a direction of pressing the latch 112 toward the unlatched position P4 (direction indicated by the arrow D3) by the first engagement arm 143. Further, when the latch 112 is pivoted from the fully-latched position P1 to the half-latched position P3 to be described later halfway to the unlatched position P4, an action of the switch lever 141 in the direction indicated by the arrow D3 is stopped by a stopper 103 formed on the actuator housing 101.

When the latch 112 is positioned at the fully-latched position P1 as illustrated in FIG. 11 and FIG. 12, the latch 112 is engaged with a pole (not shown) and thus positioned at the fully-latched position P1. Accordingly, the latch 112 is restrained from rotating about the latch shaft 112*a* in a clockwise direction (direction indicated by the arrow D4 in FIG. 12). In other words, at the fully-latched position P1, the latch 112 is restrained from rotating in a direction of unlocking the latch 112 (direction of unlatching). As a result, the vehicle door DR is held in the fully-closed state. Further, when the latch 112 is positioned at the fully-latched position P1, the arm distal end portion 143*a* of the first engagement arm 143 of the switch lever 141 is brought into abutment against the lower surface 118*a* of the latch extended portion 118 of the latch 112 from below by the elastic biasing force of the lever spring 141*a*. Further, the arm distal end portion 144*a* of the second engagement arm 144 of the switch lever 141 does not press the engagement projection 140*b* of the door switch 140 from the OFF position to the ON position. Thus, when the latch 112 is positioned at the fully-latched position P1, the actuation state of the door switch 140 is not switched to the ON state.

Figure 13:
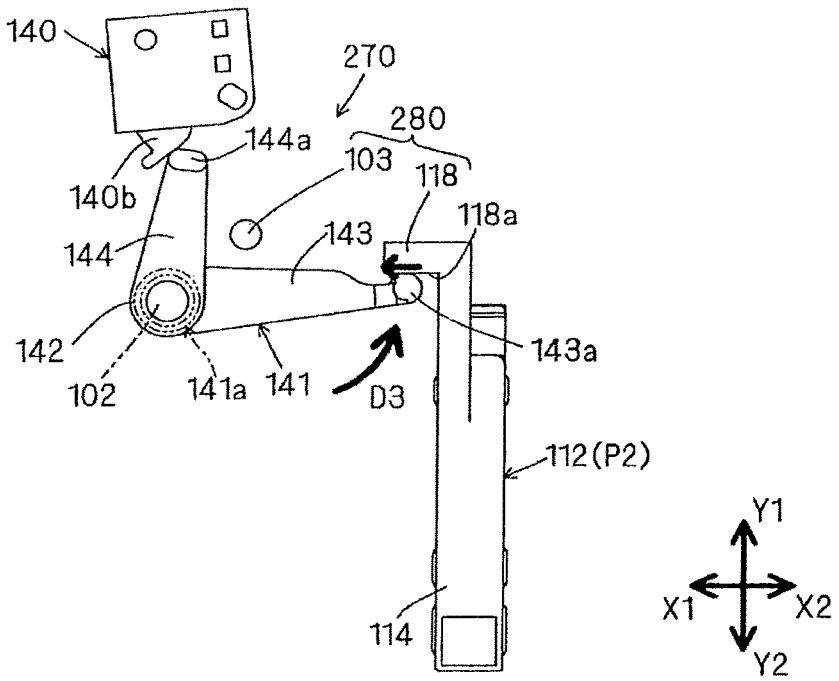
FIG. 13 is a view for illustrating the latch interlocking unit 270 of FIG. 10 as seen from the inner side of the vehicle under a state in which the latch 112 is positioned at the switching position P2.
Figure 14:
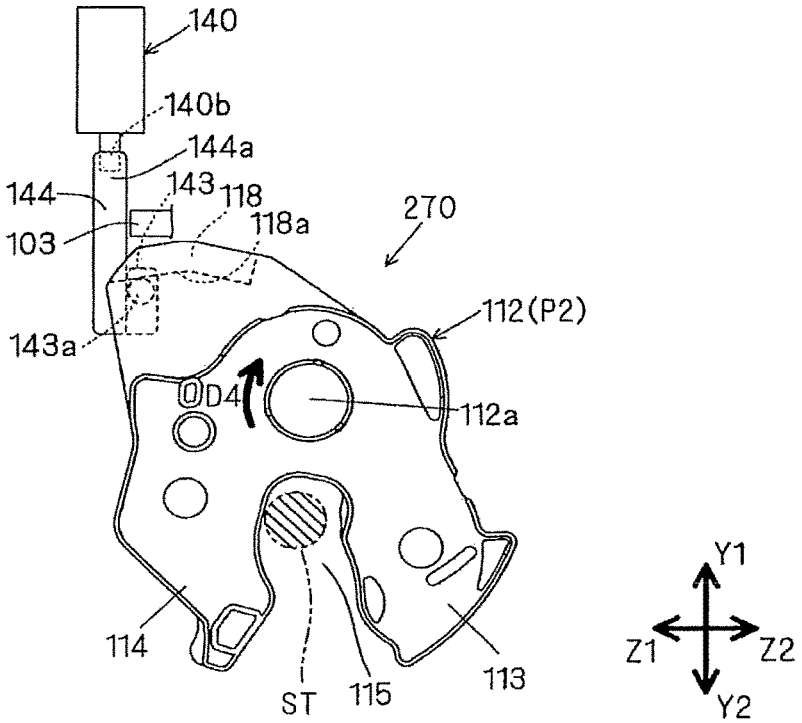
FIG. 14 is a view for illustrating the latch interlocking unit 270 of FIG. 13 as seen from the rear side of the vehicle.

After that, when the latch 112 is pivoted about the latch shaft 112*a* from the fully-latched position P1 toward the unlatched position P4 (that is, the half-latched position P3), while following an action of the latch extended portion 118 and the elastic biasing force of the lever spring 141*a*, the switch lever 141 is pivoted about the lever shaft 102 in the direction indicated by the arrow D3 in FIG. 13. As illustrated in FIG. 13 and FIG. 14, when the latch 112 is pivoted to the switching position P2 halfway to the unlatched position P4 (that is, the half-latched position P3), the switch lever 141 is pivoted in interlock with the latch 112 so as to switch the actuation state of the door switch 140 from the OFF state to the ON state. In this case, the switching position P2 is set between the fully-latched position P1 and the half-latched position P3. At this time, the arm distal end portion 143*a* of the first engagement arm 143 slides on the lower surface 118*a* of the latch extended portion 118 of the latch 112 in the vehicle frontward direction X1.

Figure 15:
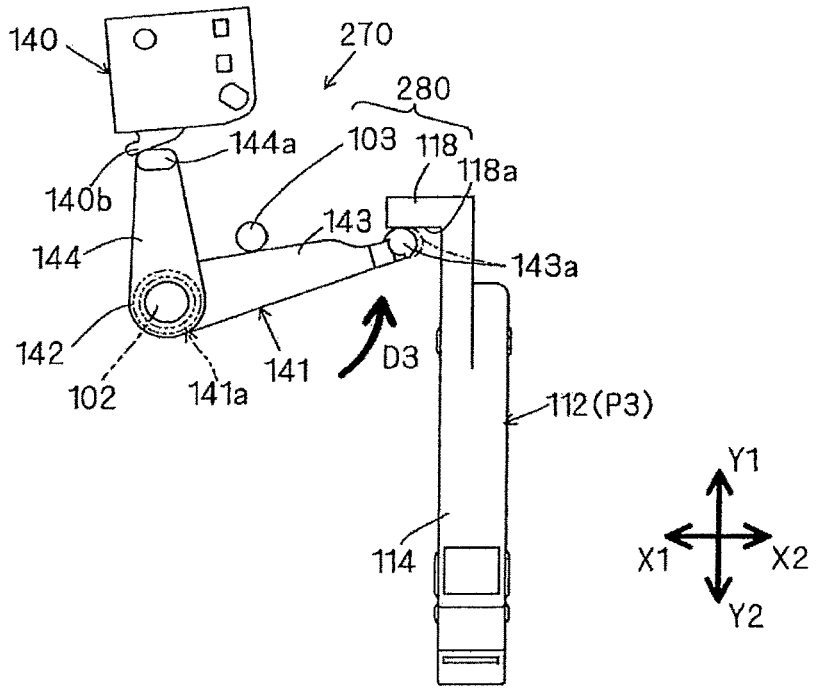
FIG. 15 is a view for illustrating the latch interlocking unit 270 of FIG. 10 as seen from the inner side of the vehicle under a state in which the latch 112 is positioned at the half-latched position P3.
Figure 16:
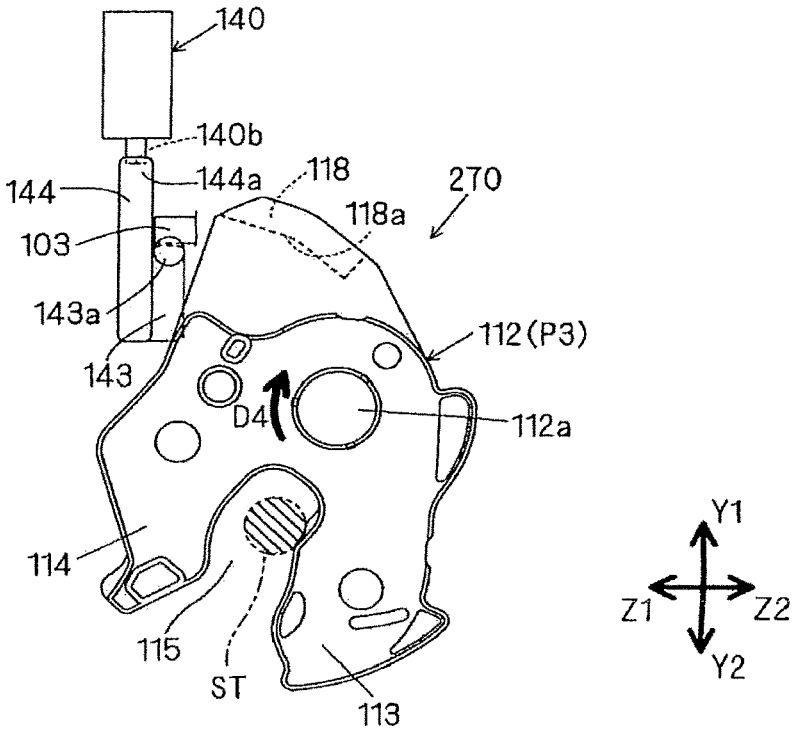
FIG. 16 is a view for illustrating the latch interlocking unit 270 of FIG. 15 as seen from the rear side of the vehicle.

As illustrated in FIG. 15 and FIG. 16, when the latch 112 is further pivoted about the latch shaft 112*a* from the switching position P2 to the half-latched position P3 toward the unlatched position P4, the switch lever 141 is pivoted about the lever shaft 102 in the direction indicated by the arrow D3 in FIG. 15 following the elastic biasing force of the lever spring 141*a*. As a result, the arm distal end portion 144*a* of the second engagement arm 144 of the switch lever 141 is brought into slide contact with the engagement projection 140*b* of the door switch 140. Thus, the actuation state of the door switch 140 is kept in the ON state. At the half-latched position P3, the action of the switch lever 141 in the direction indicated by the arrow D3 is stopped by the stopper 103 as illustrated in FIG. 15, and the arm distal end portion 143*a* of the first engagement arm 143 and the lower surface 118*a* of the latch extended portion 118 are disengaged from each other as illustrated in FIG. 16.

Figure 17:
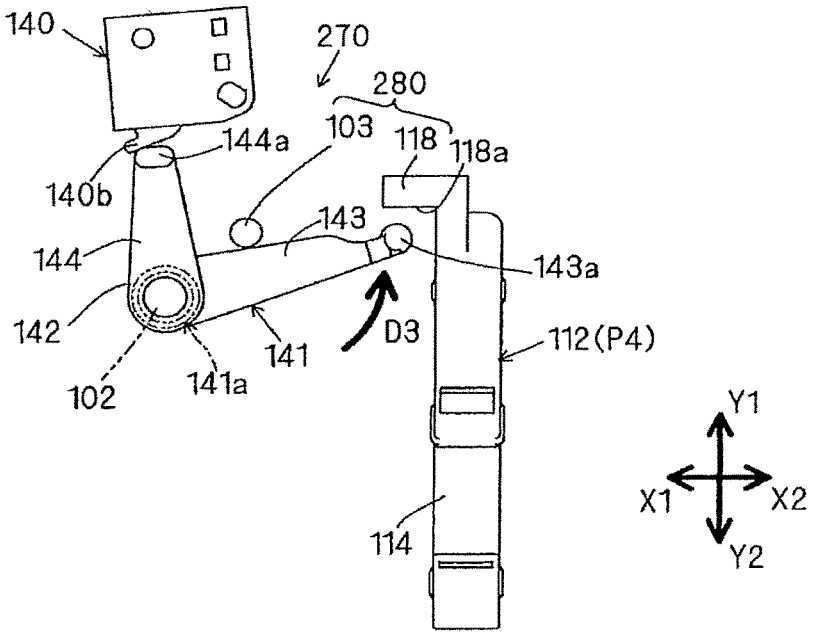
FIG. 17 is a view for illustrating the latch interlocking unit 270 of FIG. 10 as seen from the inner side of the vehicle under a state in which the latch 112 is positioned at the unlatched position P4.
Figure 18:
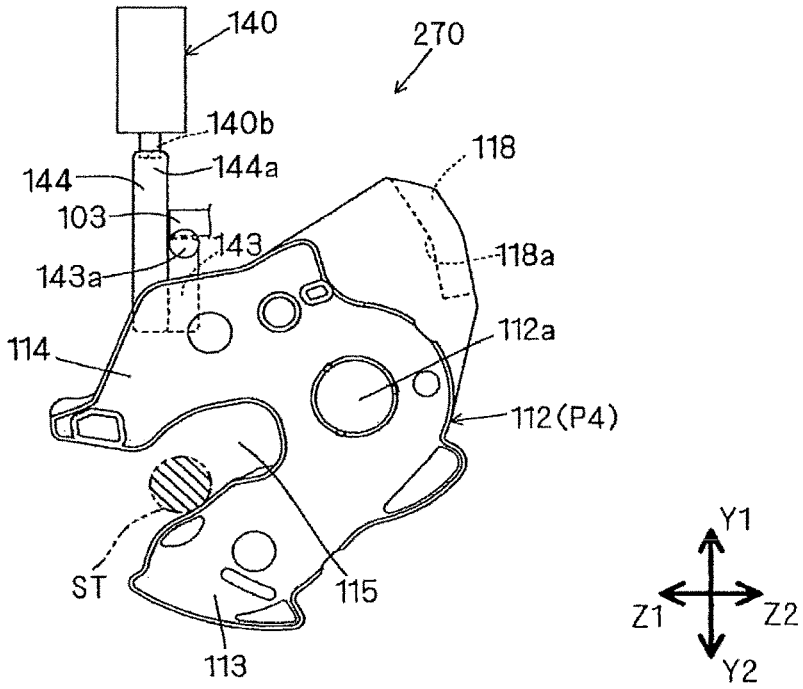
FIG. 18 is a view for illustrating the latch interlocking unit 270 of FIG. 17 as seen from the rear side of the vehicle.

As illustrated in FIG. 17 and FIG. 18, even when the latch 112 is further pivoted about the latch shaft 112*a* from the half-latched position P3 to the unlatched position P4, the first engagement arm 143 of the switch lever 141 is held pressed onto the stopper 103 by the elastic biasing force of the lever spring 141*a*. As a result, the switch lever 141 remains where it has been when the latch 112 is positioned at the half-latched position P3. That is, the pivoting position of the switch lever 141 itself is not shifted in the least, and only the relative position of the latch 112 to the switch lever 141 is shifted. As a result, the actuation state of the door switch 140 is kept in the ON state. In short, when the latch 112 is positioned within the range of from the switching position P2 to the unlatched position P4, the switch lever 141 is pivoted in interlock with the latch 112 so as to keep the actuation state of the door switch 140 in the ON state.

According to the latch interlocking unit 270 having the above-mentioned configuration, when the latch 112 is pivoted to the halfway position (half-latched position P3) from the fully-latched position P1 halfway to the unlatched position P4, the region of the arm distal end portion 143*a* of the first engagement arm 143 of the switch lever 141 to be engaged is shifted from the lower surface 118*a* of the latch extended portion 118 of the latch 112 to the stopper 103. Accordingly, the ratio of the pivoting amount of the switch lever 141 to the pivoting amount of the latch 112 is set smaller in the second pivot state in which the latch 112 is pivoted within the range of from the switching position P2 to the unlatched position P4 than in the first pivot state in which the latch 112 is pivoted within the range of from the fully-latched position P1 to the switching position P2. Specifically, the ratio is 0. In order to attain this object, the latch extended portion 118 of the latch 112 and the stopper 103 constitute a lever pivoting amount adjusting mechanism 280 configured to adjust the pivoting amount of the switch lever 141. The lever pivoting amount adjusting mechanism 280 corresponds to a "lever pivoting amount adjusting mechanism" according to the present invention. Even in a case of using the lever pivoting amount adjusting mechanism 280, there can be obtained the same operations and effects as those obtained in the case of using the lever pivoting amount adjusting mechanism 180. For example, when the lever pivoting amount adjusting mechanism is constructed only by the latch extended portion 118, the latch extended portion 118 needs to be additionally extended in the vehicle leftward direction Z1 in FIG. 12, with the result that a size of the latch 112 is increased. However, in the second embodiment, the lever pivoting amount adjusting mechanism is constructed through combination of the stopper 103 and the latch extended portion 118. Thus, increase in size of the latch 112 can be prevented.

Now, a third embodiment of the present invention is described with reference to the attached drawings.

Figure 19:
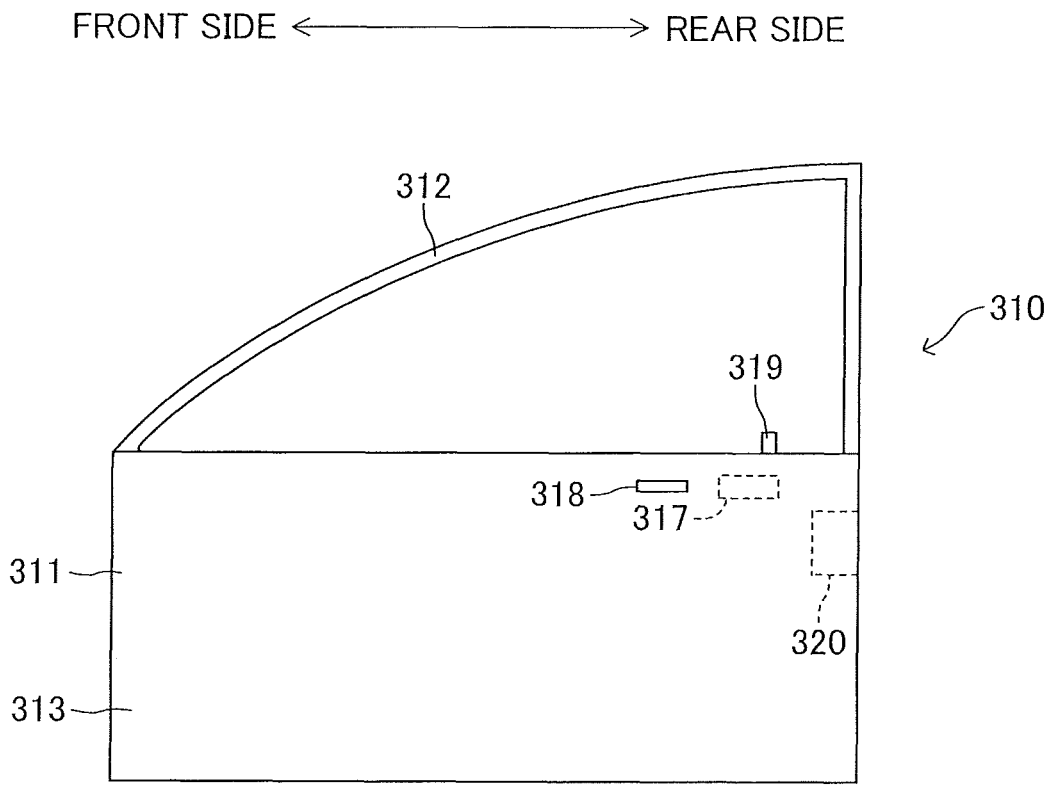
FIG. 19 is a side view for illustrating a right vehicle door including a vehicle door lock device according to a third embodiment of the present invention as seen from the inner side of the vehicle.

A vehicle door 310 illustrated in FIG. 19 is a right side door of the vehicle, and the vehicle door 310 is supported at a front end portion thereof on the vehicle body (not shown) so as to be pivotable about a pivot axis extending in the upward and downward directions. The vehicle door 310 is pivotable in a horizontal direction with respect to the vehicle body between an opened position of completely opening an opening portion formed in a side surface of the vehicle body, and a closed position of closing the opening portion. In the following description, "frontward and rearward directions" and "leftward and rightward directions (vehicle inward and outward directions)" relating to the vehicle door 310 refer to directions when the vehicle door 310 is positioned at the closed position.

The vehicle door 310 includes a door body portion 311 constituting a lower half portion of the vehicle door 310, and a door sash 312 formed at an upper half portion thereof. The door body portion 311 includes an outer panel (not shown) constituting an outer side surface of the door body portion 311, an inner panel (not shown) fixed to an inner side surface of the outer panel, and a resin trim 313 that is fixed to an inner side surface of the inner panel and constitutes an inner side surface of the door body portion 311.

An outside handle 317 is supported on the outer panel so as to be pivotable, and an inside handle 318 is supported on the trim 313 so as to be pivotable. Each of the outside handle 317 and the inside handle 318 is pivotable between an initial position and a latch releasing position, and is biased to pivot toward the initial position by biasing means (not shown).

In addition, a lock knob 319 is arranged at an upper end portion of the trim 313 so as to be slidable in the upward and downward directions. The lock knob 319 is slidable in and out of the trim 313 between an unlocked position (position illustrated in FIG. 19) and a locked position (not shown) located below the unlocked position.

A door lock device 320 is arranged inside the vehicle door 310 so as to be positioned between the outer panel and the inner panel and partially exposed from a rear end surface of the vehicle door 310.

Figure 20:
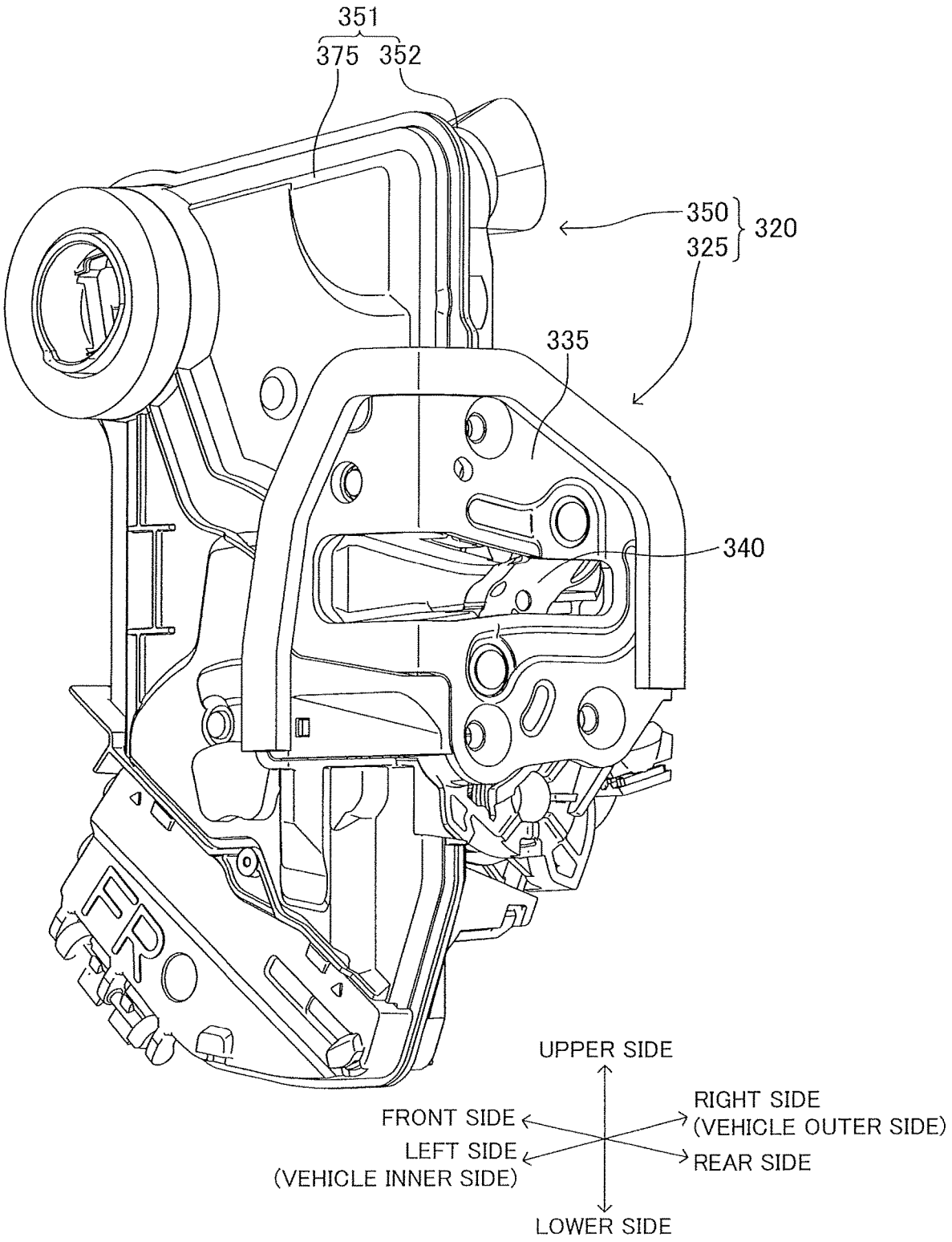
FIG. 20 is a perspective view for illustrating the door lock device as seen from a rear side of an interior of the vehicle.
Figure 21:
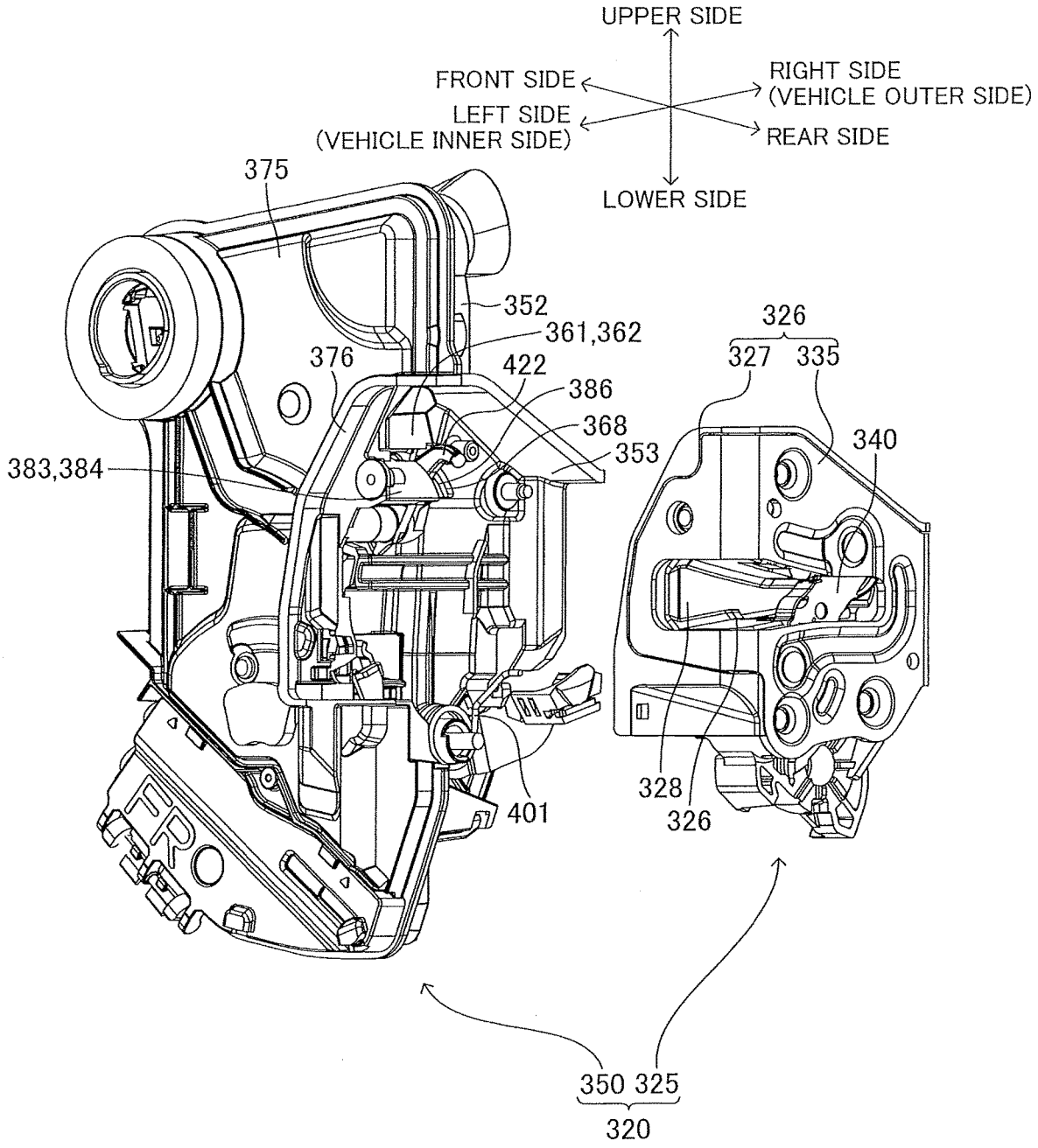
FIG. 21 is a perspective view for separately illustrating a latch unit and an actuator unit of the door lock device as seen from the rear side of the interior of the vehicle when a latch is positioned at an unlatched position.

As illustrated in FIG. 20, FIG. 21, and the like, the door lock device 320 includes a latch unit 325 and an actuator unit 350 integrated with each other.

The latch unit 325 includes a latch housing 326 (housing) consisting of a first housing 327 and a second housing 335.

A striker entry groove 328 is formed in a rear surface of the first housing 327 to extend rightward from a left end surface (end surface on the vehicle inner side) of the first housing 327. Further, a mounting recessed portion 329 is formed in the rear surface of the first housing 327 to be continuous with (communicate with) the striker entry groove 328 in a manner of crossing the striker entry groove 328. A through-hole 330 is formed in a bottom surface of the mounting recessed portion 329 to pass through the first housing 327 in the frontward and rearward directions. As illustrated in the drawings, the through-hole 330 is a long hole extending in the upward and downward directions. In addition, a latch-side waterproof wall 331 is protruded on the bottom surface and an inner peripheral surface of the mounting recessed portion 329.

A striker entry groove 336 is formed in a rear portion and a left side portion of the second housing 335 to extend in the leftward and rightward directions.

A latch 340, a pole 345, and a lift lever 348 are supported on the first housing 327 so as to be pivotable.

Figure 42:
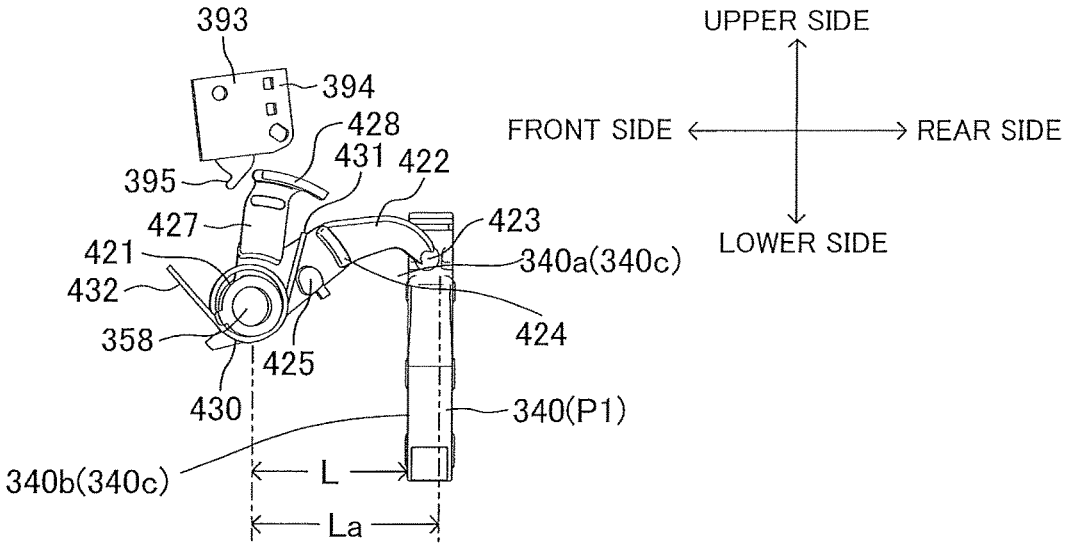
FIG. 42 is a side view for illustrating the latch, a door switch, and a switch lever as seen from the inner side of the vehicle when the latch is positioned at a fully-latched position.
Figure 43:
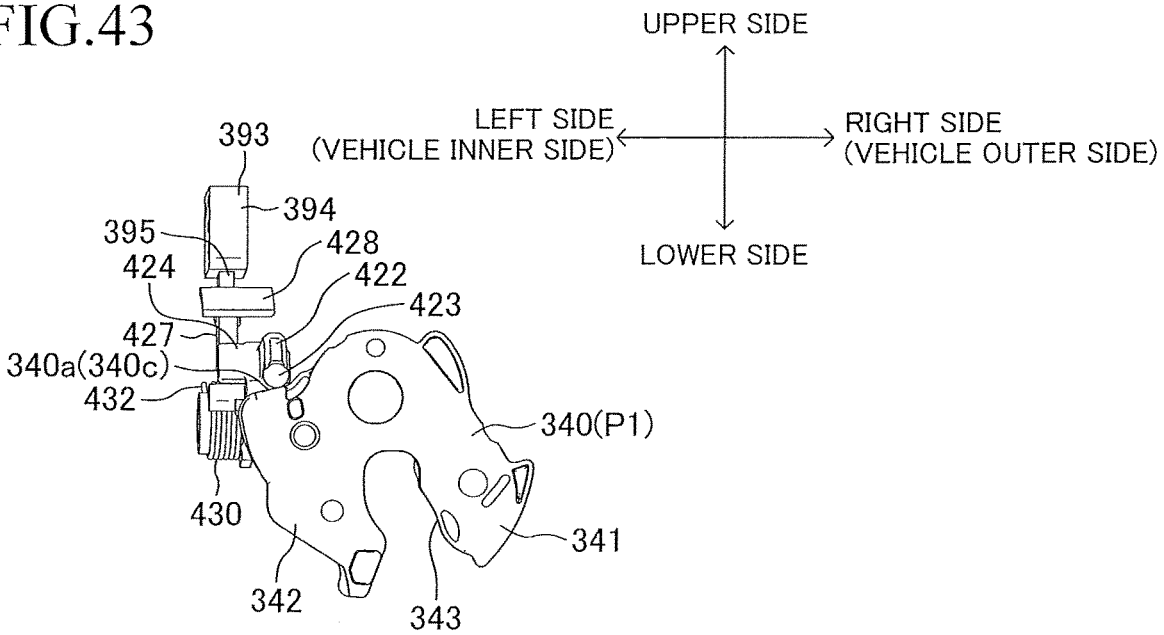
FIG. 43 is a back view for illustrating the latch, the door switch, and the switch lever of FIG. 42.

The latch 340 is arranged in the mounting recessed portion 329, and is supported so as to be pivotable about a pivot shaft formed on a support wall 329*a* that is the bottom surface of the mounting recessed portion 329. The latch 340 is pivotable with respect to the first housing 327 between an unlatched position where the latch 340 does not hold the striker (not shown) fixed to the vehicle body, that is where the latch 340 does not keep the closed state of the vehicle door 310, and a fully-latched position where the latch 340 can hold the striker, that is, the latch 340 keeps the closed state of the vehicle door 310. The latch 340 includes a first locking claw 341 and a second locking claw 342, and a striker receiving groove 343 is formed between the first locking claw 341 and the second locking claw 342. As illustrated in FIG. 42 and FIG. 43, a first engagement surface 340*a* and a second engagement surface 340*b* are formed on an outer surface of the latch 340. The first engagement surface 340*a* and the second engagement surface 340*b* constitute a lever pivoting amount adjusting mechanism 340*c* configured to adjust a pivoting amount of a switch lever 420 to be described later. The first engagement surface 340*a* is formed on a part of an outer peripheral surface of the latch 340. Meanwhile, the second engagement surface 340*b* is formed on a part of a front surface of the latch 340.

Figure 26:
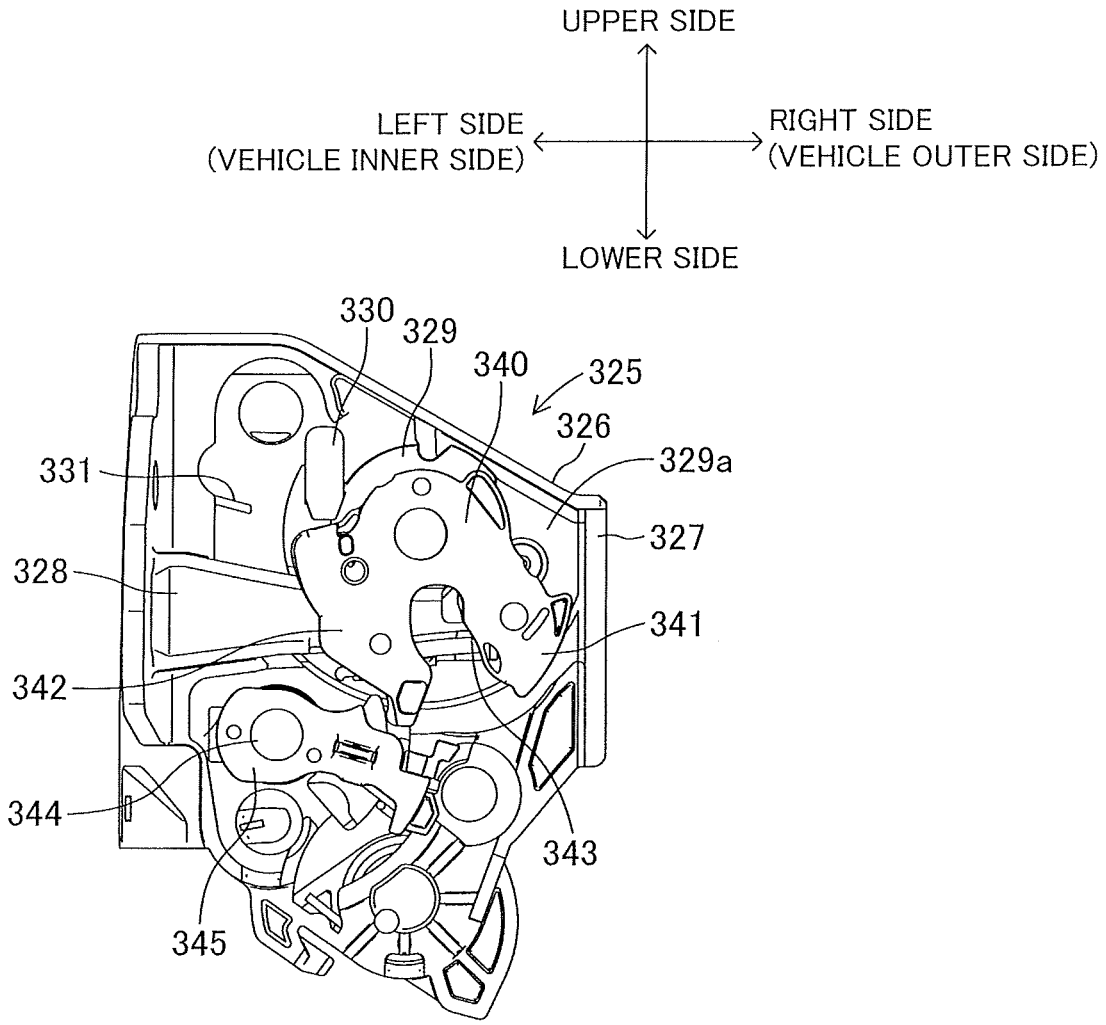
FIG. 26 is a back view for illustrating the latch unit when the latch is positioned at a fully-latched position under a state in which the second housing is dismounted.

The pole 345 is arranged in the mounting recessed portion 329 below the latch 340. The pole 345 is fixed to a pivot shaft 344 that passes through the first housing 327 in the frontward and rearward directions and is pivotable relative to the first housing 327. Therefore, the pole 345 is pivotable together with the pivot shaft 344 between an engaged position (position illustrated in FIG. 26) where the pole 345 is engaged with the latch 340 at the fully-latched position to keep the latch 340 at the fully-latched position and a disengaged position (position illustrated in FIG. 22 or FIG. 23) where the pole 345 is separated from the latch 340.

Further, a biasing force of the biasing means causes the latch 340 to be always biased to pivot to the unlatched position side, and causes the pole 345 to be always biased to pivot to the engaged position side.

Figure 24:
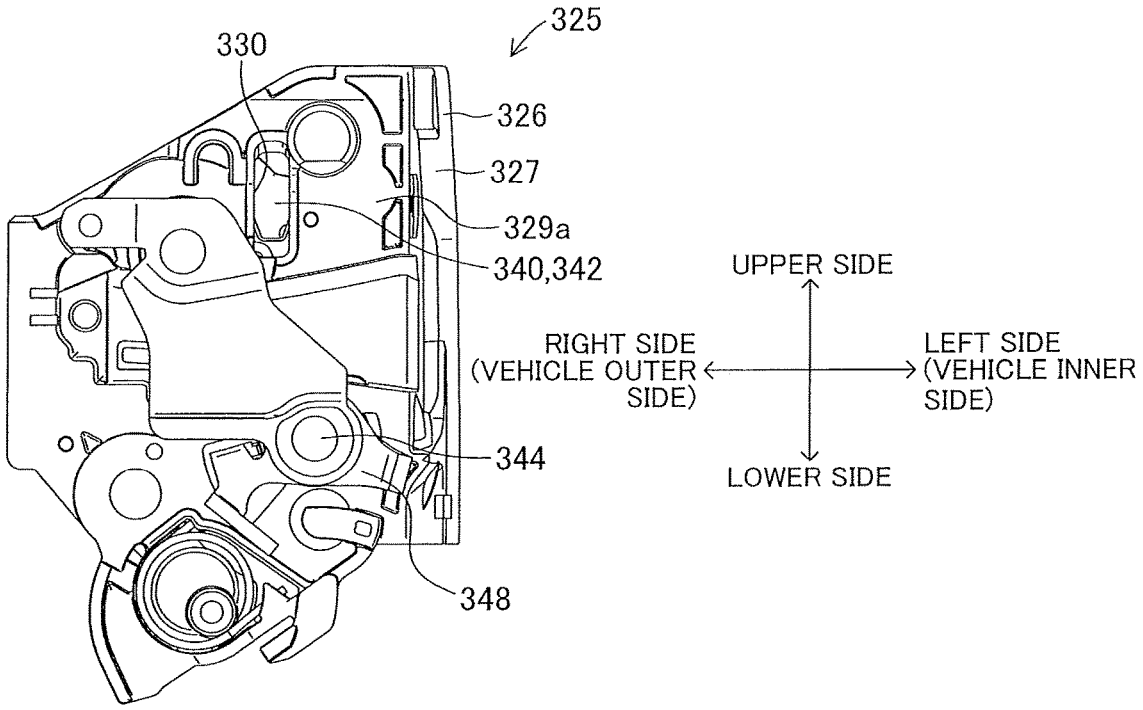
FIG. 24 is a front view for illustrating the latch unit when the latch is positioned at the unlatched position under a state in which the second housing is dismounted.

Still further, as illustrated in FIG. 24, the lift lever 348 is arranged in front of the first housing 327 so as to be opposed to a front surface of the first housing 327. The lift lever 348 is fixed to a front portion of the pivot shaft 344 protruding from the front surface of the first housing 327. That is, the lift lever 348 is pivoted together with the pivot shaft 344 and the pole 345.

When the latch 340 positioned at the unlatched position is pivoted to the fully-latched position against the biasing force of the biasing means while being engaged with the striker, the pole 345 is shifted to the engaged position by the biasing force of the biasing means, and thus engaged with the latch 340. As a result, the latch mechanism including the latch 340 and the pole 345 is switched to the "latched state" in which the latch 340 holds the striker.

Meanwhile, when the pole 345 is pivoted to the disengaged position side against the biasing force of the biasing means, the latch 340 is pivotable to the unlatched position side. Accordingly, the latch mechanism is switched to the "unlatched state" in which the latch mechanism can release the striker.

From behind the first housing 327, the second housing 335 is put on the first housing 327 supporting the latch 340, the pole 345, and the lift lever 348, and then the first housing 327 and the second housing 335 are fixed to each other. In this manner, the latch unit 325 is completed (see FIG. 20, FIG. 21, and the like).

The actuator unit 350 includes an actuator housing 351 (housing) consisting of a first housing 352 and a second housing 375.

The first housing 352 is an integrally molded resin product.

A latch unit connection portion 353 is formed on a rear portion of the first housing 352.

The first housing 352 includes a pivot shaft 354 that is formed below the latch unit connection portion 353 to extend rearward. Further, a plurality of pivot shafts 355, 356, 357, 358, and 359 are formed on a surface of the first housing 352 opposed to the second housing 375 so that an axis of each of the pivot shafts 355, 356, 357, 358, and 359 extends to the second housing 375 side. The pivot shaft 355 has a cylindrical shape with an open end surface.

Figure 30:
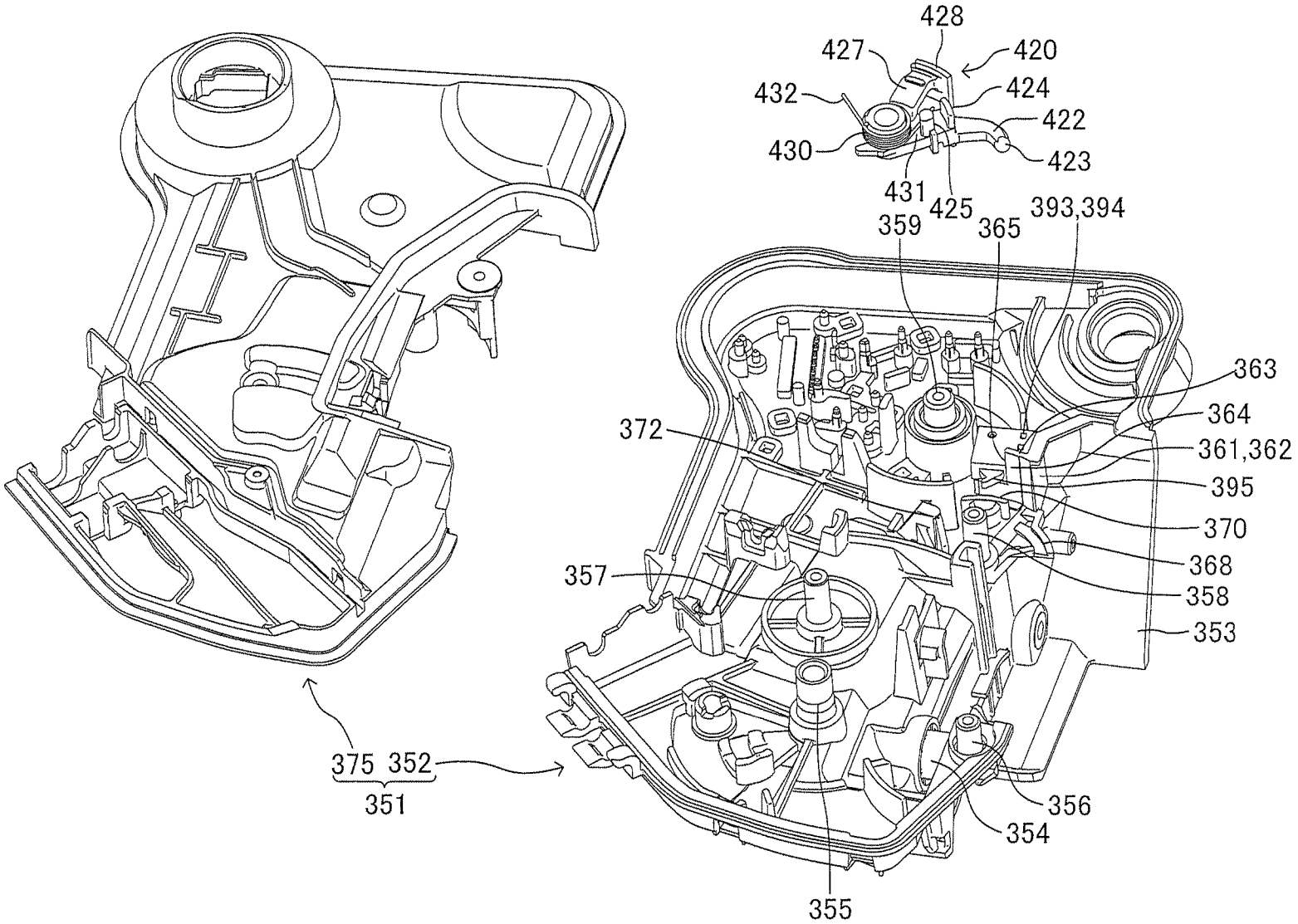
FIG. 30 is an exploded perspective view for illustrating the actuator unit as seen from a direction different from the direction of FIG. 29.

Further, a switch-side waterproof wall 361 is protruded to the second housing 375 side from the surface of the first housing 352 opposed to the second housing 375. The switch-side waterproof wall 361 integrally includes a rear wall portion 362 extending substantially in the upward and downward directions, and a bottom wall portion 363 extending from a lower end of the rear wall portion 362 forward and substantially horizontally. As illustrated in FIG. 30, a cutout portion 365 is formed in the bottom wall portion 363. A region of the bottom wall portion 363 directly behind the cutout portion 365 constitutes a rearward opposing portion 364 extending in the leftward and rightward directions.

Still further, a lever guide protrusion 368 (inner wall) is protruded to the second housing 375 side from the surface of the first housing 352 opposed to the second housing 375. As illustrated in the drawings, the lever guide protrusion 368 has a circular arc shape having a center corresponding to the axis of the pivot shaft 358.

Still further, a lower waterproof wall 370 is protruded to the second housing 375 side from the surface of the first housing 352 opposed to the second housing 375. As illustrated in the drawings, the lower waterproof wall 370 is located forward of the lever guide protrusion 368. Further, the lower waterproof wall 370 has a circular arc shape having a center corresponding to the axis of the pivot shaft 358 and having a diameter substantially equal to a diameter of the lever guide protrusion 368.

Still further, a spring locking portion 372, which is located in the vicinity of the pivot shaft 358, is protruded to the second housing 375 side from the surface of the first housing 352 opposed to the second housing 375.

The second housing 375 is an integrally molded resin product.

A latch unit connection portion 376 is formed on a rear portion of the second housing 375.

A fitting protrusion 378 is protruded from a surface of the second housing 375 opposed to the first housing 352. Further, bearing portions 379, 380, 381, and 382 are formed on the surface of the second housing 375 opposed to the first housing 352. Each of the bearing portion 379 and the bearing portion 382 is a recessed portion formed in the second housing 375, and each of the bearing portion 380 and the bearing portion 381 has a cylindrical shape with an open end surface.

Figure 29:
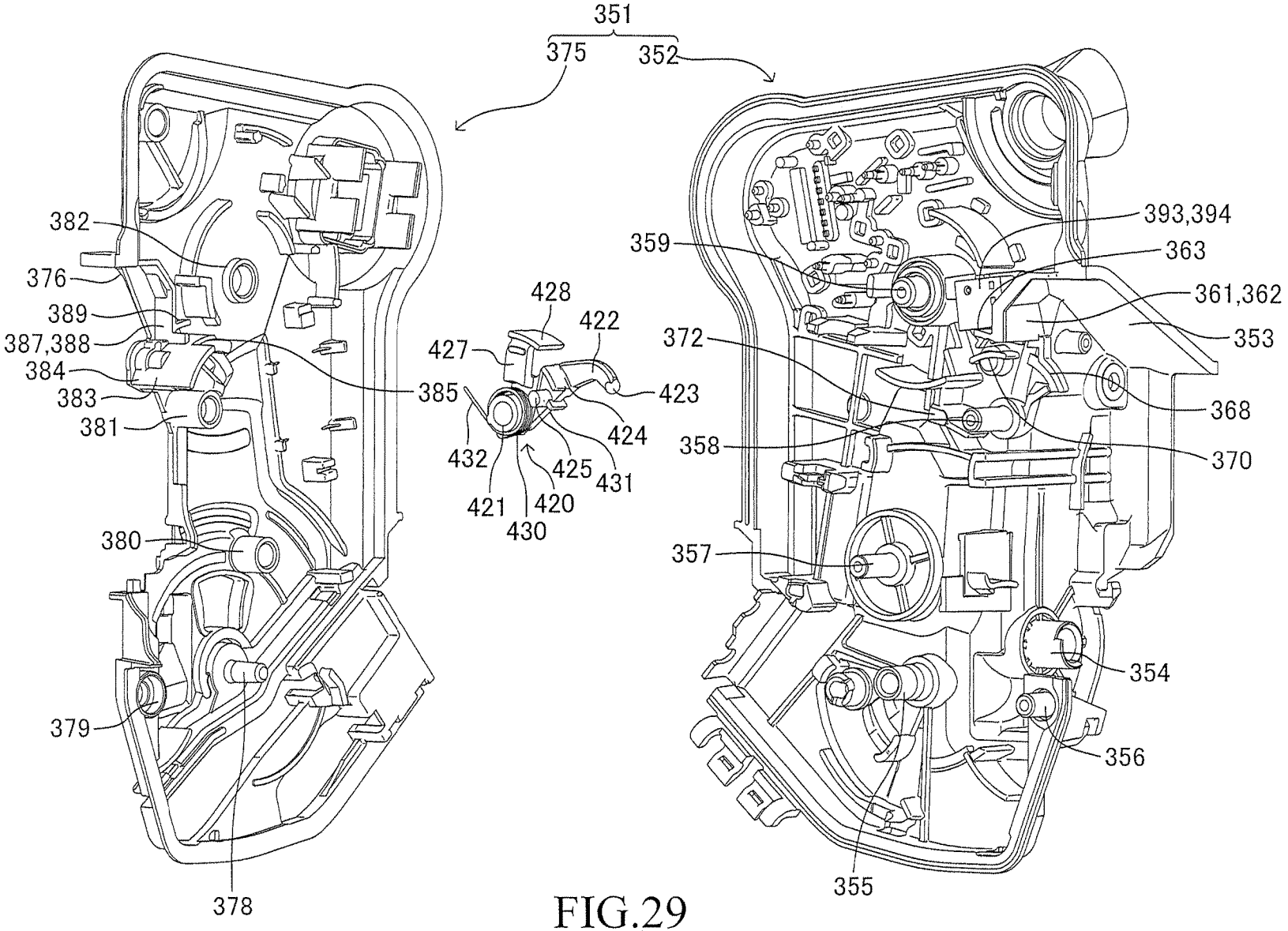
FIG. 29 is an exploded perspective view for illustrating the actuator unit.
Figure 31:
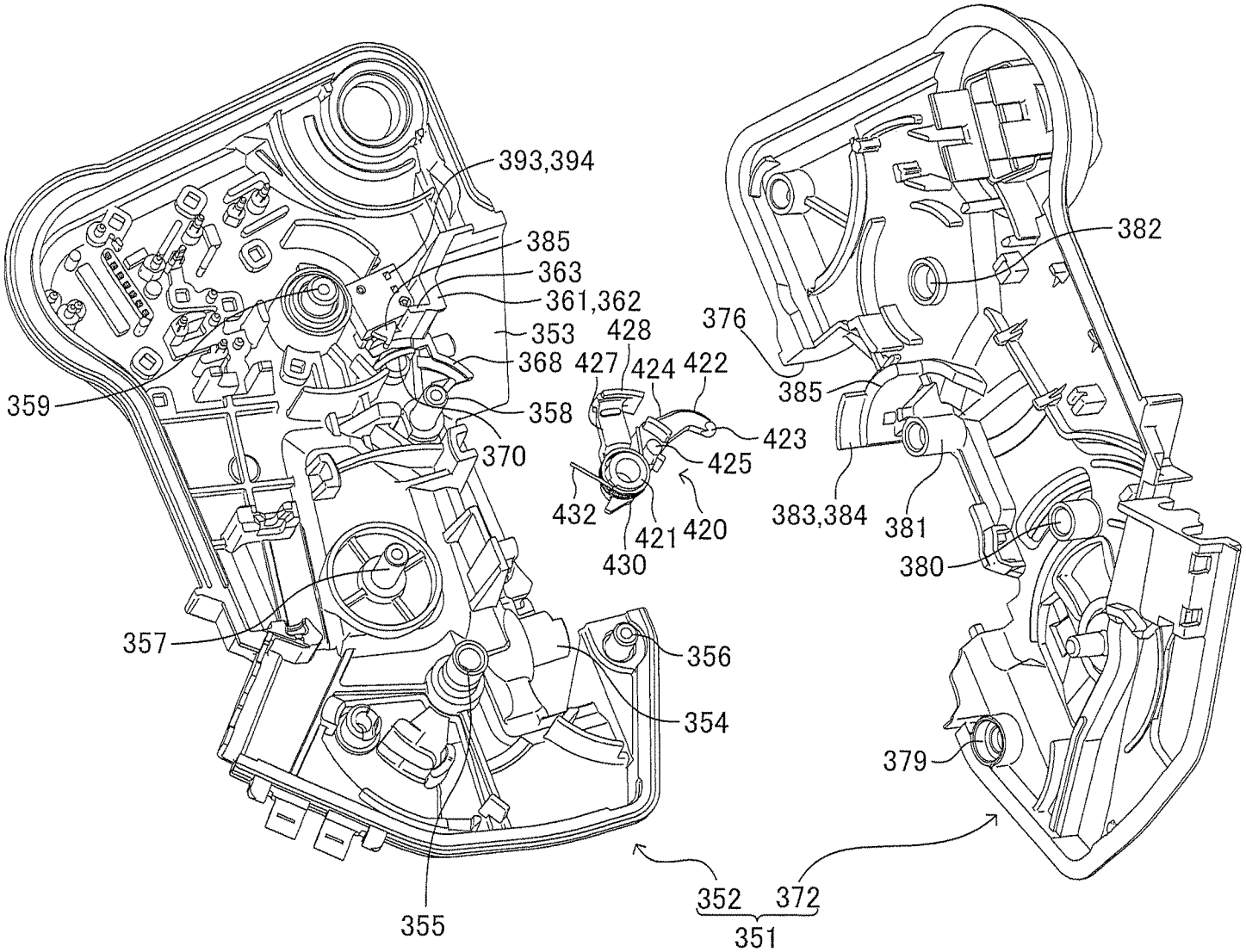
FIG. 31 is an exploded perspective view for illustrating the actuator unit as seen from a direction different from the directions of FIG. 29 and FIG. 30.

Further, a lever guide protrusion 383 (inner wall) is protruded to the first housing 352 side from the surface of the second housing 375 opposed to the first housing 352. As illustrated in the drawings, the lever guide protrusion 383 has a circular arc shape having a center corresponding to an axis of the bearing portion 381. As illustrated in FIG. 29, FIG. 31, and the like, the lever guide protrusion 383 integrally includes a wide portion 384 and a narrow portion 385. The wide portion 384 constitutes a rear portion of the lever guide protrusion 383. The narrow portion 385 constitutes a front portion of the lever guide protrusion 383, and is smaller in width than the wide portion 384.

Still further, a switch-side waterproof wall 387, which is located directly above the lever guide protrusion 383, is protruded to the first housing 352 side from the surface of the second housing 375 opposed to the first housing 352. The switch-side waterproof wall 387 integrally includes a rear wall portion 388 extending substantially in the upward and downward directions, and a bottom wall portion 389 extending from a lower end of the rear wall portion 388 forward and substantially horizontally.

As illustrated in the drawings, a door switch 393 (courtesy switch or switch) being an electrical component is fixed to the surface of the first housing 352 opposed to the second housing 375.

The door switch 393 includes a main body 394 and a pressed projection 395 (engagement projection) that projects downward from a lower end surface of the main body 394 and is pivotable relative to the main body 394. The pressed projection 395 is pivotable relative to the main body 394 about a pivot axis extending in the leftward and rightward directions. Specifically, the pressed projection 395 is pivotable between an OFF position illustrated in FIG. 29 to FIG. 31, FIG. 33, FIG. 36, and FIG. 37, and an ON position illustrated in FIG. 32 and FIG. 39. In addition, the pressed projection 395 is biased to move to the OFF position side by biasing means arranged in the main body 394.

Figure 32:
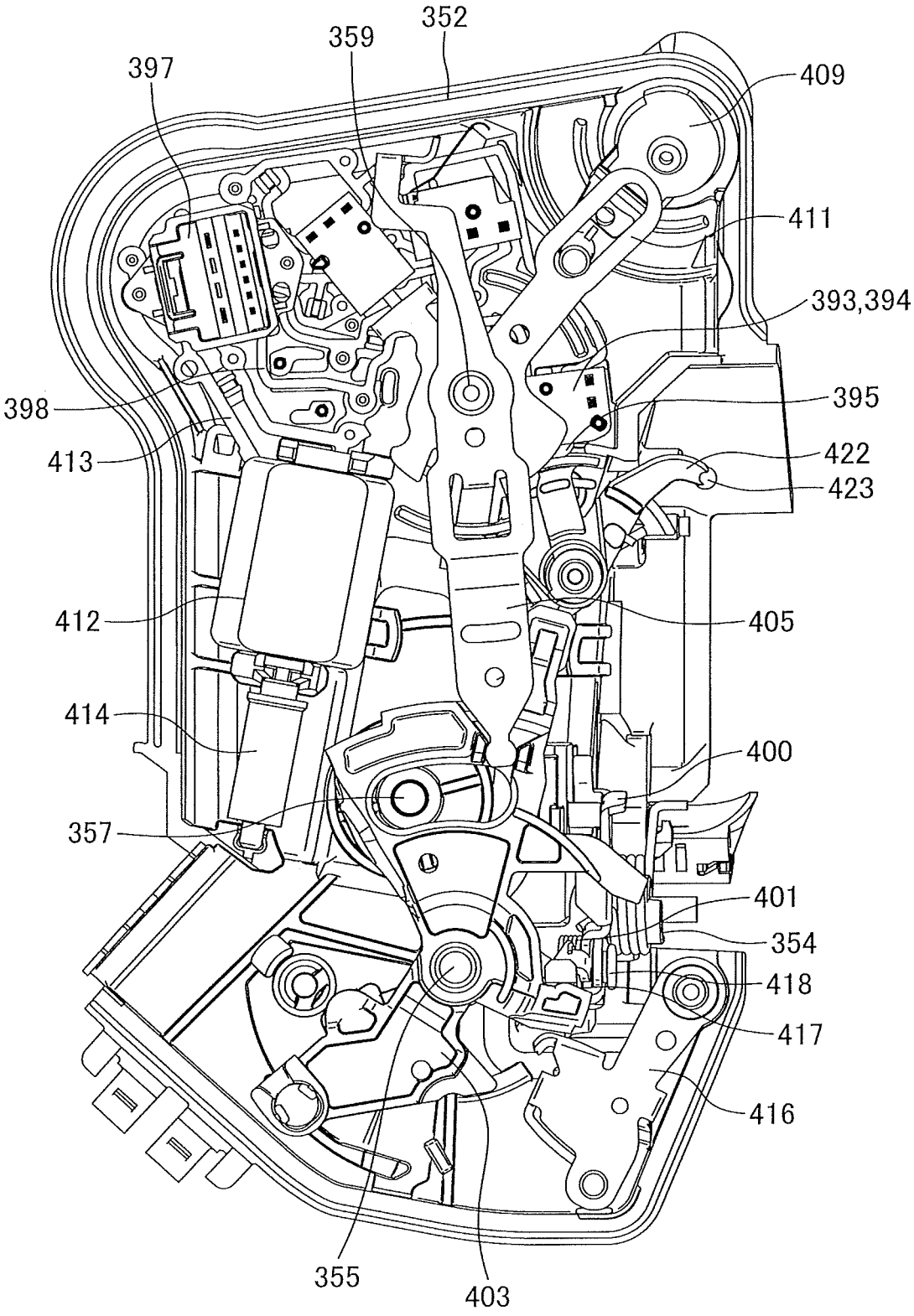
FIG. 32 is a side view for illustrating the actuator unit as seen from the inner side of the vehicle when the latch of the latch unit (not shown) is positioned at the unlatched position under a state in which the second housing is dismounted.
Figure 33:
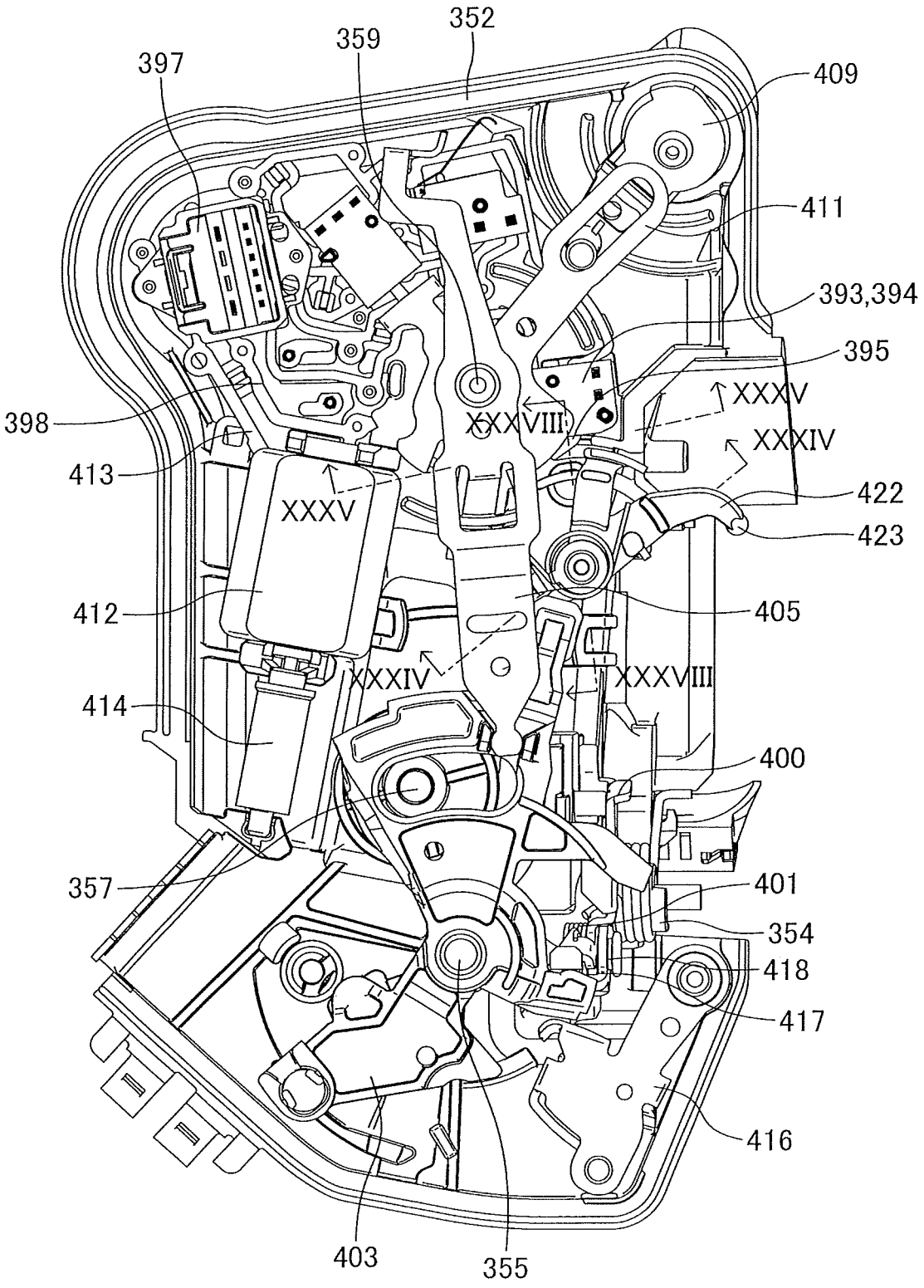
FIG. 33 is a side view, which is similar to FIG. 32, for illustrating the actuator unit when the latch is positioned at a latched position.

As illustrated in FIG. 32 and FIG. 33, a connector 397 is fixed to the surface of the first housing 352 opposed to the second housing 375. A door switch terminal 398 configured to connect the door switch 393 and the connector 397 to each other is fixed to the surface of the first housing 352 opposed to the second housing 375. The connector 397 is connected to an electronic control unit (ECU) (not shown) through a cable (not shown). In addition, the ECU is connected to a lighting device (not shown) arranged on an inner surface (for example, a ceiling surface) of the vehicle.

An open link 400 illustrated in FIG. 32 and FIG. 33 is pivotable between a locked position and an unlocked position. As described later, an outside open lever 417 is supported on (the pivot shaft 354 of) the first housing 352 so as to be pivotable, and the open link 400 is supported on a support shaft 418 so as to be pivotable. The support shaft 418 is protruded on the outside open lever 417. In addition, a biasing spring 401 is arranged between the support shaft 418 and the open link 400. The biasing spring 401 biases the open link 400 to pivot toward the unlocked position.

As illustrated in FIG. 32 and FIG. 33, an active lever 403 is supported on the pivot shaft 355 of the first housing 352 so as to be pivotable.

The active lever 403 is pivotable between an unlocking position (position illustrated in FIG. 32 or FIG. 33) of allowing the open link 400 to be positioned at the unlocked position, and a locking position (not shown) of holding the open link 400 at the locked position.

The active lever 403 and the lock knob 319 are linked with each other through an operation wire (not shown). When the lock knob 319 is positioned at the locked position, the active lever 403 is positioned at the locking position. As a result, the open link 400 is positioned at the locked position. Meanwhile, when the lock knob 319 is moved from the locked position to the unlocked position, the active lever 403 is pivoted to the unlocking position by a moving force of the lock knob 319, and the open link 400 is moved to the unlocked position.

As illustrated in FIG. 32 and FIG. 33, a locking control lever 405 is supported on the pivot shaft 359 of the first housing 352 so as to be pivotable. Further, an outside locking lever 409 is linked with a key cylinder (not shown) arranged on the outer panel or the outside handle 317. In addition, a key switch lever 411 links the locking control lever 405 and the outside locking lever 409 with each other.

Further, as illustrated in FIG. 32 and FIG. 33, an electric motor 412 is fixed to the surface of the first housing 352 opposed to the second housing 375. A motor terminal 413 configured to connect the electric motor 412 and the connector 397 to each other is fixed to the surface of the first housing 352 opposed to the second housing 375. The electric motor 412 is actuated through operation of a remote controller being one of locking and unlocking operation members.

A worm gear 414 is fixed to an output shaft of the electric motor 412.

A disc-shaped wheel gear (not shown) is supported on the pivot shaft 357 of the first housing 352 so as to be pivotable. Gear teeth formed on an outer peripheral surface of the wheel gear are meshed with the worm gear 414. In addition, the wheel gear is linked with the active lever 403.

When the electric motor 412 is rotated in response to a signal from the ECU, a rotating force of the electric motor 412 is transmitted to the wheel gear through the worm gear 414, and thus the wheel gear is rotated. Then, the active lever 403 linked with the wheel gear is pivoted between the locking position and the unlocking position.

An inside open lever 416 is supported on the pivot shaft 356 of the first housing 352 so as to be pivotable.

The inside open lever 416 and the inside handle 318 are linked with each other by the operation wire.

When the inside handle 318 is positioned at the initial position, the inside open lever 416 is positioned at an unpressing position. At this time, the inside open lever 416 does not apply any force to the open link 400.

Meanwhile, when the inside handle 318 is moved from the initial position to a latch releasing position, the inside open lever 416 is moved to a pressing position. When the inside open lever 416 is moved to the pressing position under a state in which the open link 400 is positioned at the unlocked position, the inside open lever 416 presses the open link 400. Thus, the open link 400 is pivoted in a predetermined direction.

Further, an outside open lever 417 is supported on the pivot shaft 354 so as to be pivotable.

The outside open lever 417 is connected to the outside handle 317 through a rod.

When the outside handle 317 is positioned at the initial position, the outside open lever 417 is positioned at an unpressing position. At this time, the outside open lever 417 does not apply any force to the open link 400.

Meanwhile, when the outside handle 317 is moved from the initial position to a latch releasing position, the outside open lever 417 is moved to a pressing position. When the outside open lever 417 is moved to the pressing position under the state in which the open link 400 is positioned at the unlocked position, the outside open lever 417 presses the open link 400. Thus, the open link 400 is pivoted in the predetermined direction.

The switch lever 420 is supported on the pivot shaft 358 (lever shaft) of the first housing 352 so as to be pivotable.

The switch lever 420 includes a cylindrical boss portion 421 that is mounted on the pivot shaft 358 so as to be pivotable. The switch lever 420 further includes a first engagement arm 422 extending from the boss portion 421 in a radial direction of the boss portion 421.

A distal end portion of the first engagement arm 422 is constituted by an arm distal end portion 423 having a substantially spherical shape. Further, a first waterproof wall 424 (hole closing side portion) is protruded from a left side surface of the first engagement arm 422. The first waterproof wall 424 has a circular arc shape having a center corresponding to an axis of the boss portion 421. Still further, a spring locking portion 425 is protruded from the left side surface of the first engagement arm 422 nearer to the boss portion 421 than the first waterproof wall 424.

Figure 41:
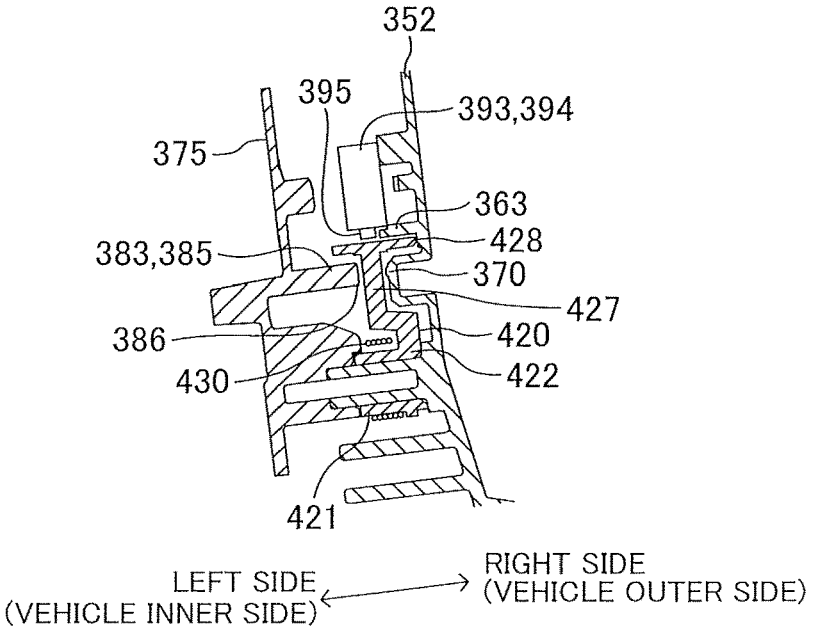
FIG. 41 is a sectional view, which is similar to FIG. 38, for illustrating the actuator unit when the latch is positioned at the unlatched position.

As illustrated in FIG. 29, FIG. 30, FIG. 41, and the like, a second engagement arm 427 extends from a left side surface of an intermediate portion of the first engagement arm 422 in the radial direction of the boss portion 421 to be located counterclockwise (forward) of the first engagement arm 422. That is, the second engagement arm 427 is offset leftward with respect to the first engagement arm 422. In addition, a second waterproof wall 428 (hole closing side portion) is protruded from a distal end portion of the second engagement arm 427 to be located on an outer peripheral side of the first waterproof wall 424. The second waterproof wall 428 has a circular arc shape having a center corresponding to the axis of the boss portion 421.

Figure 34:
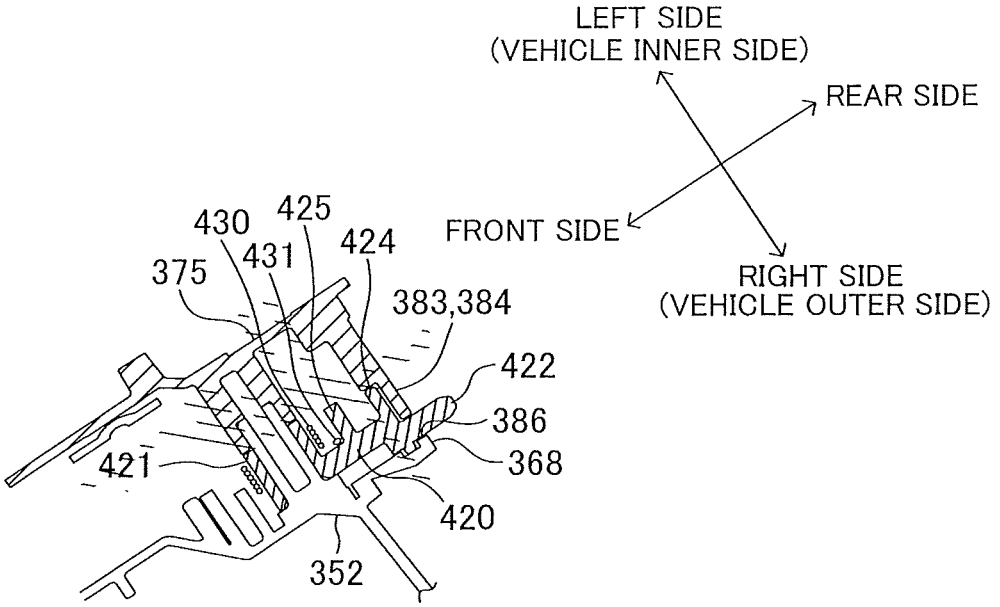
FIG. 34 is a sectional view taken along the line XXXIV-XXXIV of FIG. 33.

When the boss portion 421 of the switch lever 420 is mounted to the pivot shaft 358, as illustrated in FIG. 34, the first engagement arm 422 is located leftward of the lever guide protrusion 368 and the lower waterproof wall 370.

Figure 36:
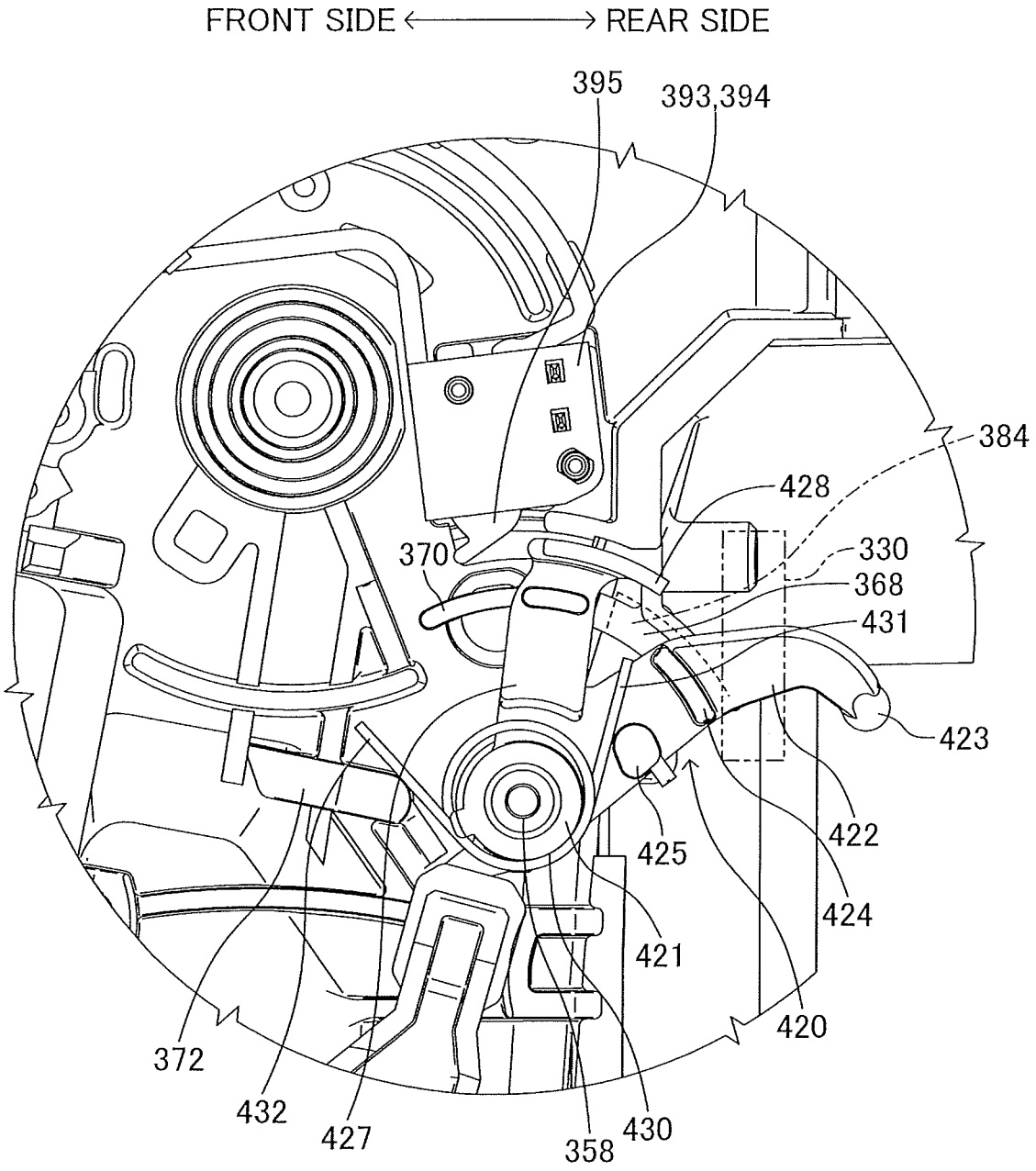
FIG. 36 is an enlarged side view for illustrating relevant parts of FIG. 33.
Figure 37:
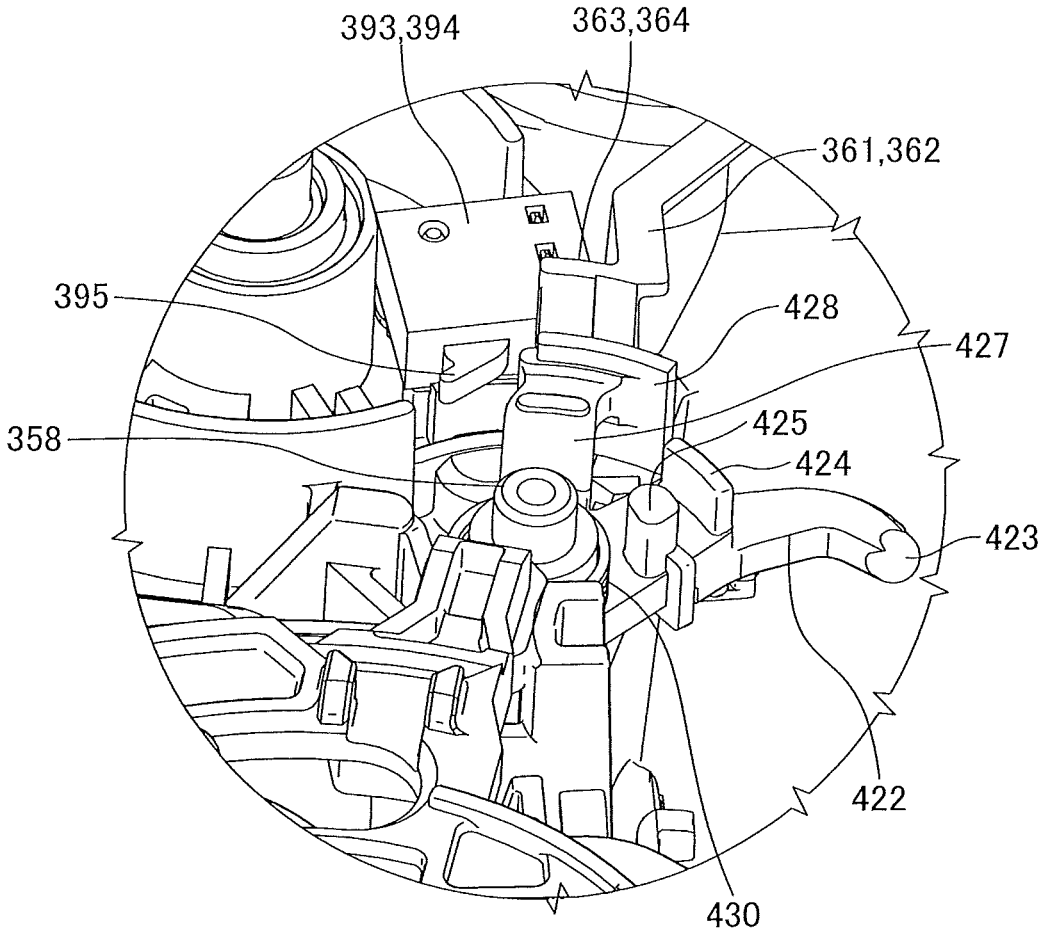
FIG. 37 is an enlarged bottom perspective view for illustrating the same parts as the parts illustrated in FIG. 36.
Figure 38:
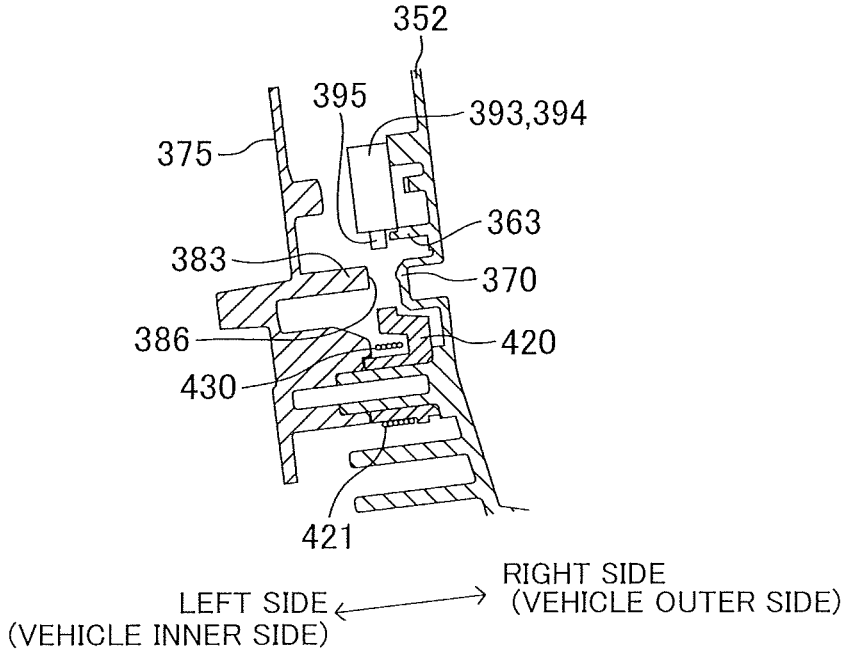
FIG. 38 is a sectional view taken along the line XXXVIII-XXXVIII of FIG. 33.
Figure 39:
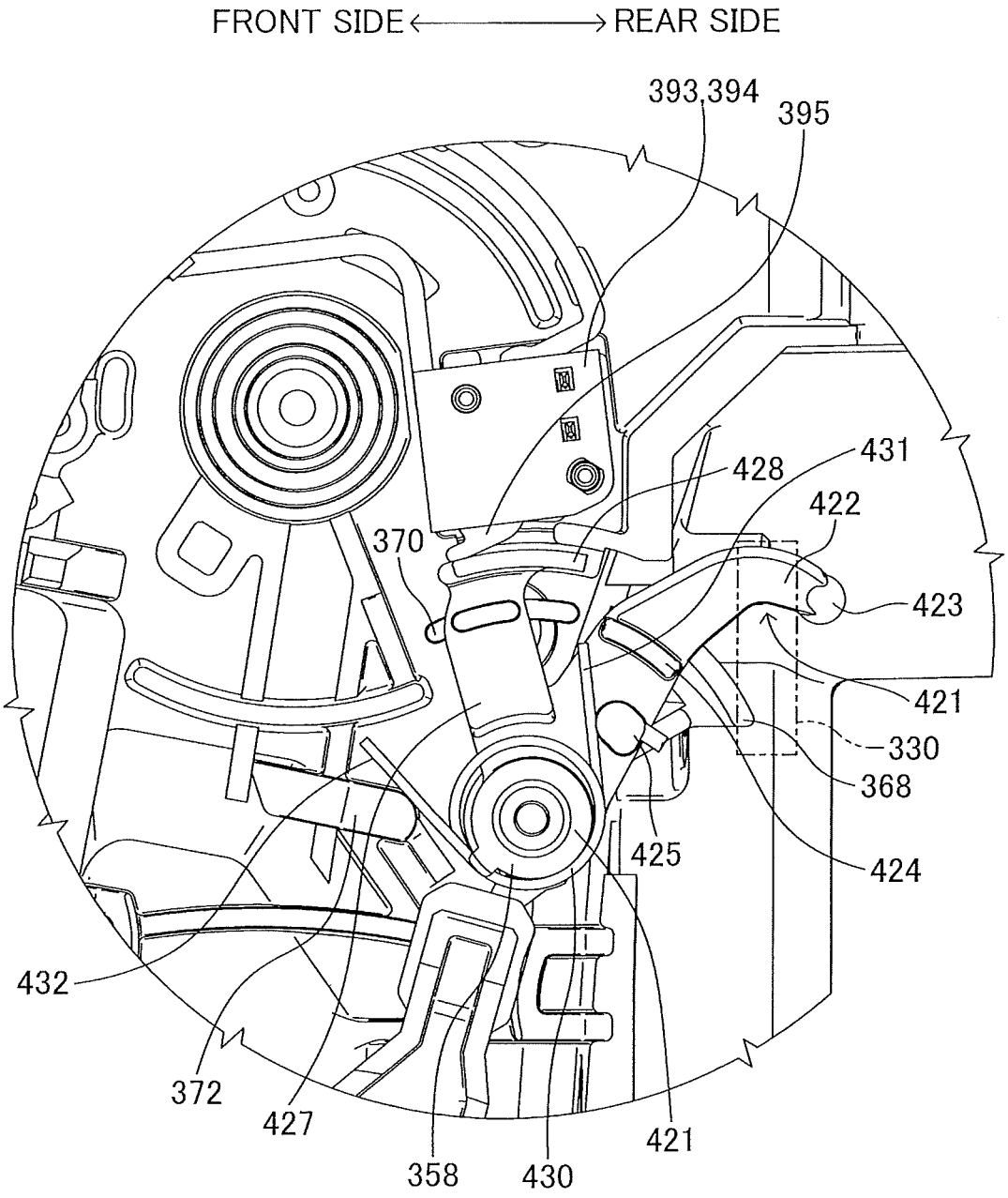
FIG. 39 is an enlarged side view, which is similar to FIG. 36, for illustrating the actuator unit when the latch of the latch unit (not shown) is positioned at the unlatched position.
Figure 40:
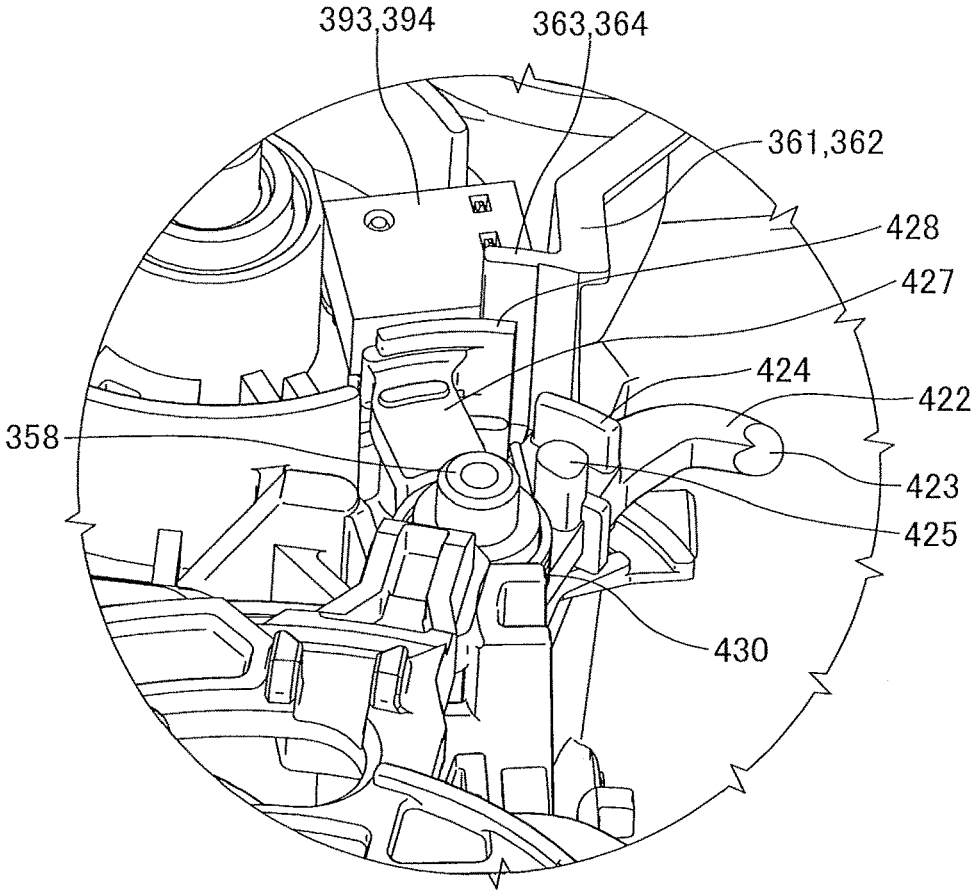
FIG. 40 is an enlarged bottom perspective view, which is similar to FIG. 37, for illustrating the actuator unit when the latch is positioned at the unlatched position.

In addition, a lever spring 430 is mounted to the pivot shaft 358. The lever spring 430 includes a pair of locking pieces 431 and 432. As illustrated in FIG. 36 and FIG. 39, one locking piece 431 is locked to (engaged with) the spring locking portion 425 of the switch lever 420. The other locking piece 432 is locked to (engaged with) the spring locking portion 372 of the first housing 352. When the lever spring 430 is thus locked to (engaged with) the first housing 352 and (the spring locking portion 425) of the switch lever 420, the lever spring 430 is elastically deformed. Further, a biasing force generated by the lever spring 430 causes the switch lever 420 to be always biased to pivot about the pivot shaft 358 in a clockwise direction in FIG. 36 and FIG. 39.

The first housing 352 and the second housing 375 are fixed to each other by fixing means under a state in which opposed portions of outer peripheral edges of the first housing 352 and the second housing 375 are held in contact with each other. Thus, the actuator unit 350 is completed.

When the actuator unit 350 is completed, the fitting protrusion 378 of the second housing 375 is fitted to the pivot shaft 355 of the first housing 352, and the pivot shafts 356, 357, 358, and 359 of the first housing 352 are fitted to the bearing portions 379, 380, 381, and 382 of the second housing 375, respectively.

Further, as illustrated in FIG. 34, FIG. 41, and the like, the lever guide protrusion 368 and the lower waterproof wall 370 of the first housing 352, and the wide portion 384 of the lever guide protrusion 383 of the second housing 375 are opposed to each other with a switch lever movement allowing groove 386 (gap) formed therebetween. The first engagement arm 422 of the switch lever 420 is positioned in the switch lever movement allowing groove 386 so as to be pivotable.

Figure 35:
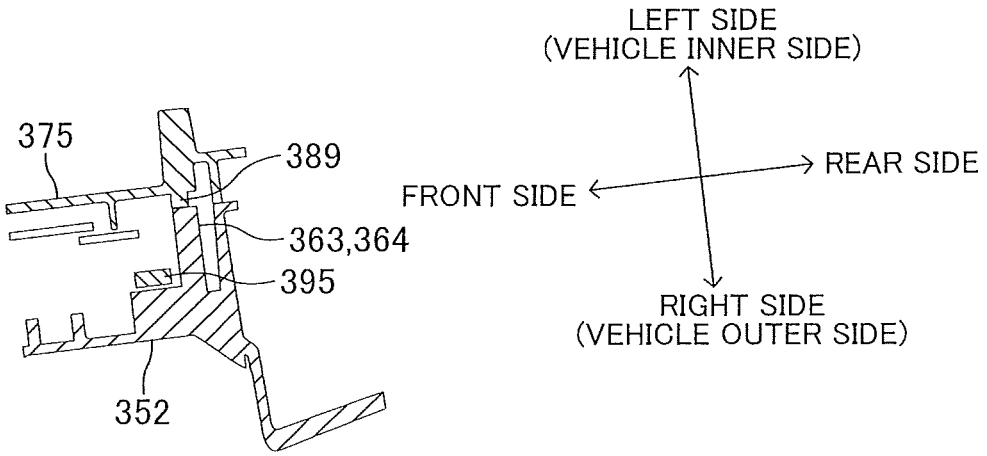
FIG. 35 is a sectional view taken along the line XXXV-XXXV of FIG. 33.

Still further, the rear wall portion 362 of the switch-side waterproof wall 361 of the first housing 352 and the rear wall portion 388 of the switch-side waterproof wall 387 of the second housing 375 are held in contact with each other, and as illustrated in FIG. 35, the bottom wall portion 363 of the switch-side waterproof wall 361 and the bottom wall portion 389 of the switch-side waterproof wall 387 are held in contact with each other. Further, as illustrated in FIG. 35, the bottom wall portion 363 (the rearward opposing portion 364) is positioned directly behind the pressed projection 395 of the door switch 393.

Still further, as illustrated in FIG. 36 and FIG. 41, the second engagement arm 427 of the switch lever 420 is positioned rightward of the narrow portion 385 of the lever guide protrusion 383 and directly in front of the wide portion 384.

Still further, as illustrated in FIG. 36, FIG. 39, and FIG. 41, the first waterproof wall 424 of the switch lever 420 is located on an inner peripheral side of the lever guide protrusion 368, the lower waterproof wall 370, and the lever guide protrusion 383, and the second waterproof wall 428 of the switch lever 420 is located on an outer peripheral side of the lever guide protrusion 368, the lower waterproof wall 370, and the lever guide protrusion 383.

Figure 27:
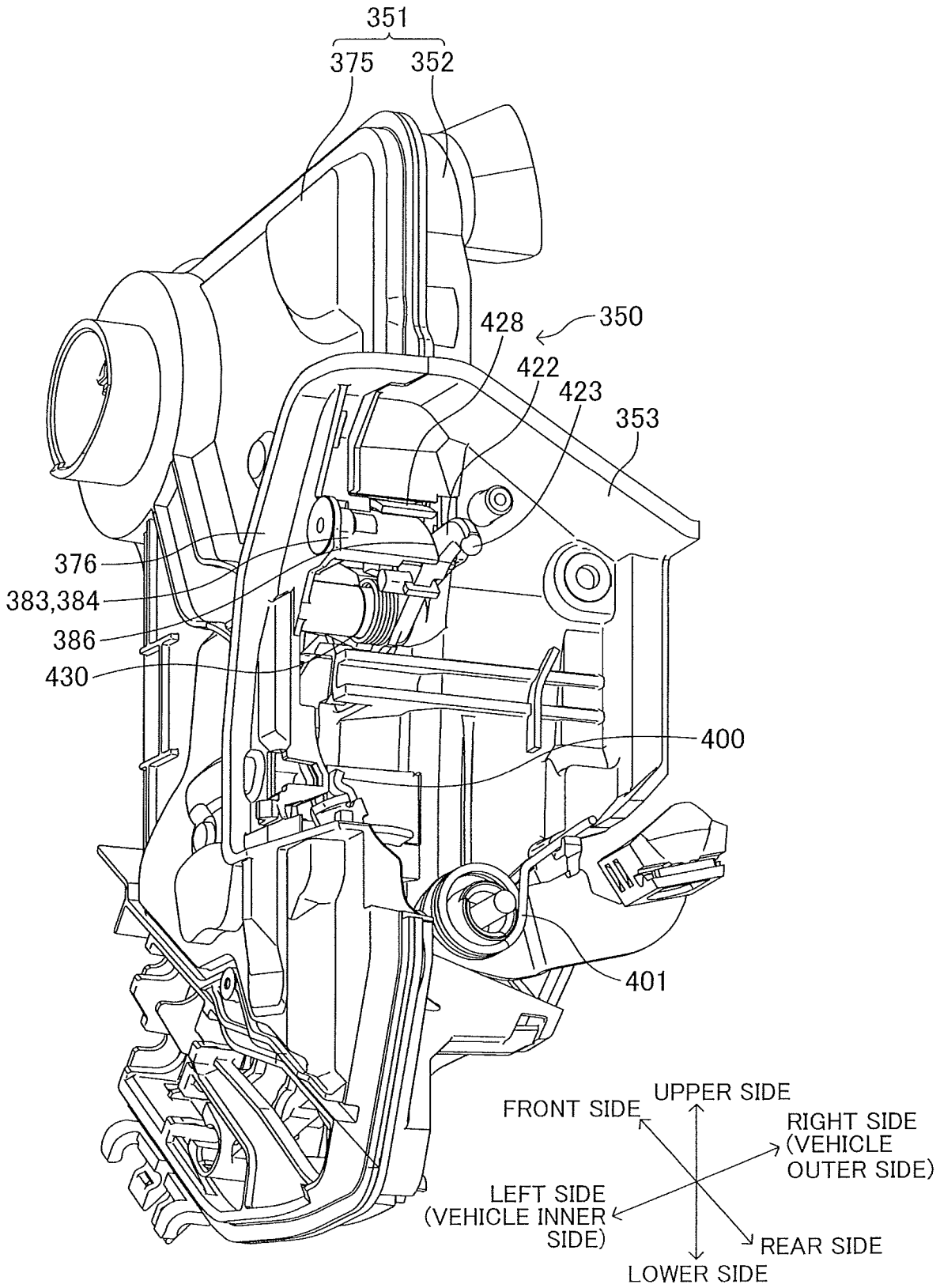
FIG. 27 is a perspective view for illustrating the actuator unit as seen from the rear side of the interior of the vehicle.
Figure 28:
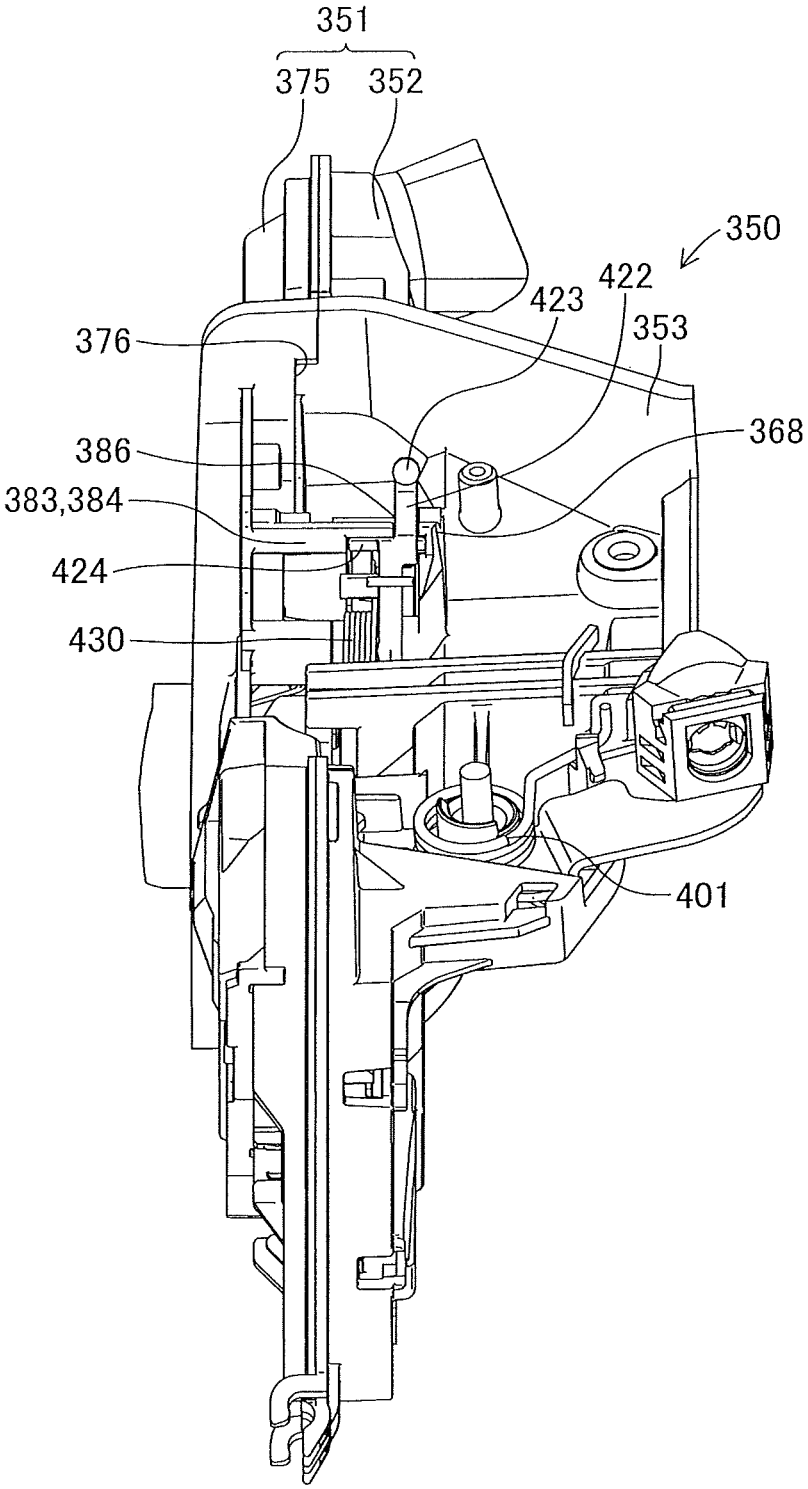
FIG. 28 is a rear bottom perspective view for illustrating the actuator unit.

Still further, the rear surface of the actuator housing 351 has an opening portion surrounded by the latch unit connection portion 353 of the first housing 352 and the latch unit connection portion 376 of the second housing 375 (see FIG. 21 and FIG. 27). Further, the distal end portion (arm distal end portion 423) of the first engagement arm 422 of the switch lever 420 is positioned in the opening portion.

The active lever 403, the inside open lever 416, the outside open lever 417, the electric motor 412, the worm gear 122, and the wheel gear of the actuator unit 350 are components of the locking mechanism.

The latch unit 325 is mounted into the opening portion surrounded by the latch unit connection portion 353 of the first housing 352 and the latch unit connection portion 376 of the second housing 375, and the latch unit 325 and the actuator unit 350 are fixed to each other. Thus, the door lock device 320 is completed.

When the door lock device 320 is completed, in the opening portion surrounded by the latch unit connection portion 353 of the first housing 352 and the latch unit connection portion 376 of the second housing 375, a distal end portion (upper end portion) of the open link 400 of the actuator unit 350 is opposed to the lift lever 348 of the latch unit 325.

Further, as illustrated in FIG. 36, FIG. 39, FIG. 42, and FIG. 43, a distal end region of the first engagement arm 422 of the switch lever 420 with respect to the first waterproof wall 424 passes through the through-hole 330 of the latch unit 325, and the arm distal end portion 423 is brought into contact with the latch 340 in the latch unit 325. Accordingly, the switch lever 420 biased by the lever spring 430 is restrained by the latch 340 from pivoting to the wide portion 384 side.

Still further, as is apparent from FIG. 32, FIG. 33, FIG. 36, and FIG. 39, the door switch 393, the connector 397, the door switch terminal 398, and the motor terminal 413 being electrical components are located opposite to (forward of) the latch 340 and the pole 345 through intermediation of the support wall 329*a*, and are located above the through-hole 330 of the latch unit 325.

The operations and effects of the switch lever 420 and the latch 340 (the lever pivoting amount adjusting mechanism 40*c*) at the time of pivoting of the latch 340 between the fully-latched position P1 and the unlatched position P4 are the same as those of the first embodiment.

Further, the striker entry groove 328 and the striker entry groove 336 are formed in the latch unit 325. Accordingly, when a user washes the vehicle, for example, under a state in which the vehicle door 310 is open, liquid such as water to be used for washing (hereinafter, simply referred to as "water") may intrude into the latch unit 325 through the striker entry groove 328 and the striker entry groove 336, and may further intrude into the actuator unit 350 through the through-hole 330. The door switch 393 being an electrical component is arranged inside the actuator unit 350. When water adheres to the door switch 393, the door switch 393 may malfunction. Accordingly, it is necessary to prevent water having intruded into the latch unit 325 from adhering to the door switch 393.

However, in the third embodiment, as described below, a risk of adhesion of water to the door switch 393 is extremely low.

Figure 22:
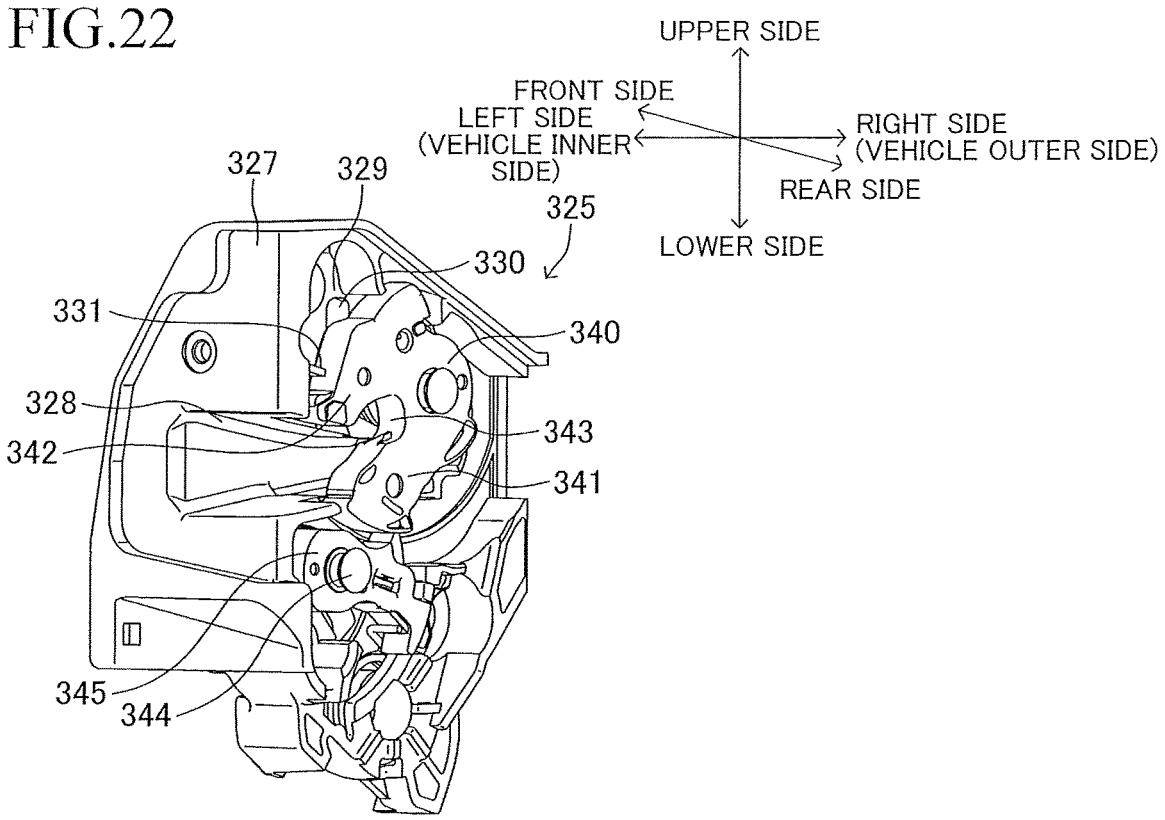
FIG. 22 is a perspective view for illustrating the latch unit as seen from the rear side of the interior of the vehicle when the latch is positioned at the unlatched position under a state in which a second housing is dismounted.
Figure 23:
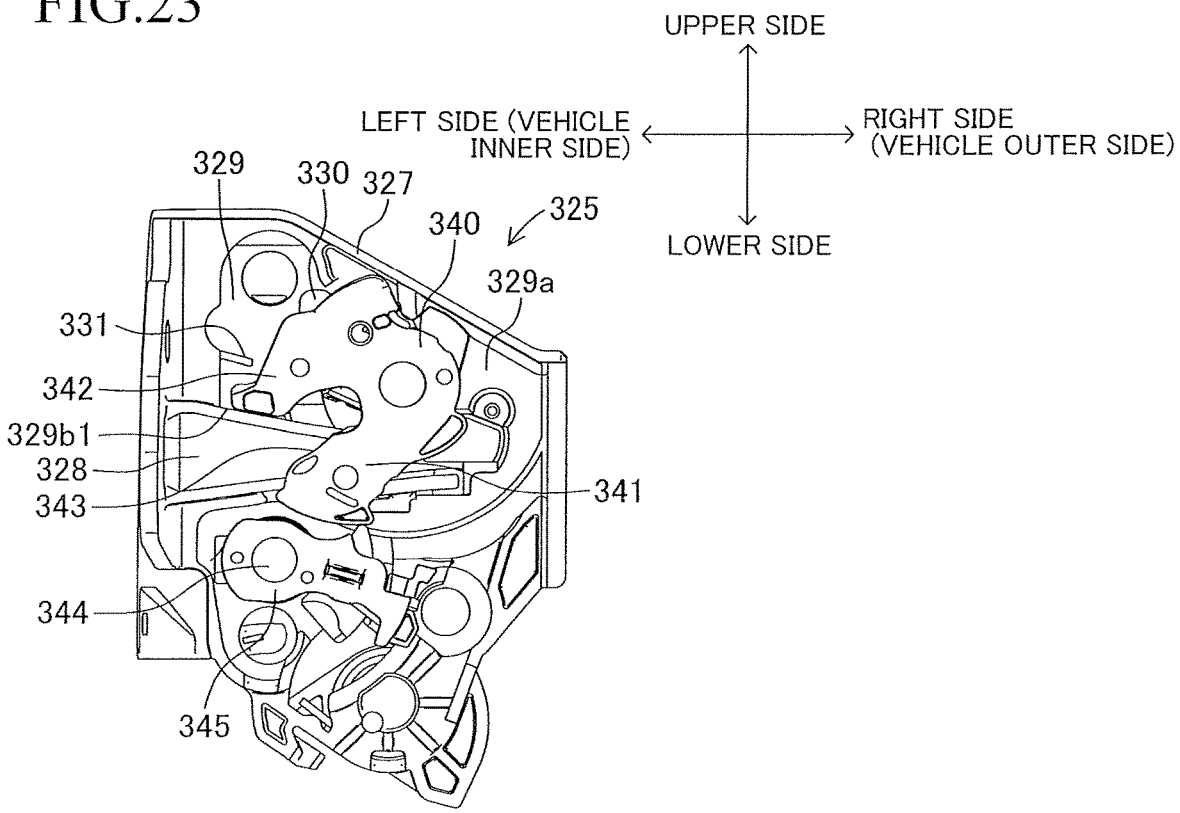
FIG. 23 is a back view for illustrating the latch unit when the latch is positioned at the unlatched position under a state in which the second housing is dismounted.

When the vehicle door 310 is in the opened state, the latch 340 is positioned at the unlatched position by the biasing force of the biasing means. As illustrated in FIG. 22, FIG. 23, and FIG. 24, the latch 340 overlaps a substantially entire part of the through-hole 330 as seen from a thickness direction of the support wall 329*a*, that is, from the frontward and rearward directions when the vehicle door 310 is closed. That is, the second locking claw 342 of the latch 340 overlaps the entire part of the through-hole 330 excluding an upper end part thereof. Further, as is apparent from FIG. 36 and FIG. 39, when the latch 340 and the switch lever 420 are positioned at any positions, the first waterproof wall 424 and the second waterproof wall 428 of the switch lever 420 overlap at least a part of the through-hole 330 as seen from the thickness direction of the support wall 329*a*.

In addition, when the latch 340 is positioned between the switching position P2 and the unlatched position P4, the second waterproof wall 428 of the switch lever 420 is held in contact with the pressed projection 395 of the door switch 393 from below. In other words, the second waterproof wall 428 covers the pressed projection 395 from below.

Further, as illustrated in FIG. 27, FIG. 28, FIG. 34, FIG. 36, FIG. 39, and FIG. 41, the first waterproof wall 424 of the switch lever 420 is positioned on the inner peripheral side of the lever guide protrusion 368, the lower waterproof wall 370, and the lever guide protrusion 383, and the second waterproof wall 428 of the switch lever 420 is positioned on the outer peripheral side of the lever guide protrusion 368, the lower waterproof wall 370, and the lever guide protrusion 383. In other words, the first waterproof wall 424 and the second waterproof wall 428 overlap a part of the switch lever movement allowing groove 386 as seen from the thickness direction (radial direction) of the lever guide protrusion 368, the lower waterproof wall 370, and the lever guide protrusion 383. That is, in order that water having intruded into the actuator unit 350 through the through-hole 330 may flow toward the door switch 393, the water needs to pass through a gap between the first waterproof wall 424 and the switch lever movement allowing groove 386, and to flow upward through the switch lever movement allowing groove 386. Then, the water needs to further pass through a gap between the switch lever movement allowing groove 386 and the second waterproof wall 428, and to flow to the door switch 393 side. Accordingly, the actuator unit 350 is structured such that water is less liable to pass through the switch lever movement allowing groove 386 as compared to a case where the switch lever 420 does not include the first waterproof wall 424 and the second waterproof wall 428.

Accordingly, the latch 340 positioned at the unlatched position and the switch lever 420 can prevent water having intruded into the latch unit 325 from flowing through the through-hole 330 toward the door switch 393 arranged inside the actuator unit 350.

Further, as is apparent from FIG. 21, FIG. 36, and FIG. 39, the lever guide protrusion 368 and the lower waterproof wall 370 of the first housing 352, and the wide portion 384 of the lever guide protrusion 383 of the second housing 375 are positioned between the through-hole 330 of the latch unit 325 and the door switch 393.

Accordingly, even if water flows through the through-hole 330 of the support wall 329*a* to the door switch 393 side, the lever guide protrusion 368, the lower waterproof wall 370, and the wide portion 384 can effectively prevent the water from flowing to the door switch 393 side.

Further, as illustrated in FIG. 35, the bottom wall portion 363 (the rearward opposing portion 364) of the switch-side waterproof wall 361 and the bottom wall portion 389 of the switch-side waterproof wall 387 are held in contact with each other, and the rearward opposing portion 364 is positioned directly behind the pressed projection 395 of the door switch 393.

Accordingly, even when water flows through the through-hole 330 of the support wall 329*a* to the door switch 393 side, the switch-side waterproof wall 361 (the bottom wall portion 363) and the switch-side waterproof wall 387 (the bottom wall portion 389) can effectively prevent the water from adhering to the door switch 393.

Figure 25:
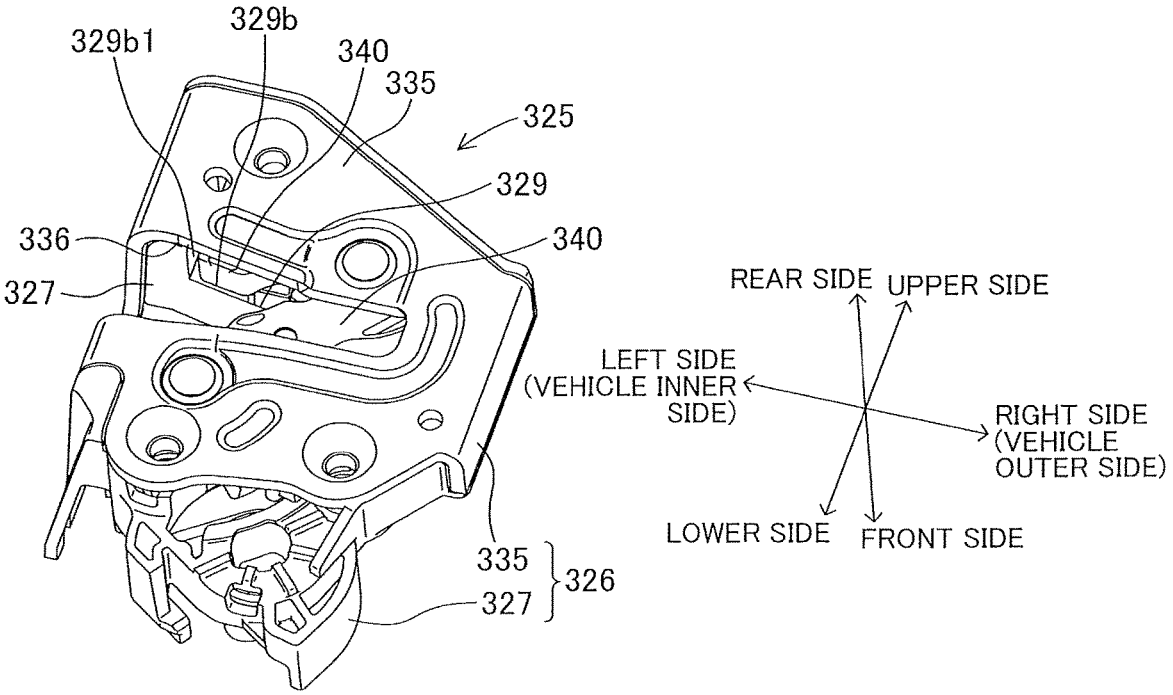
FIG. 25 is a bottom perspective view for illustrating the latch unit when the latch is positioned at the unlatched position.

Further, when the vehicle door 310 is in the opened state, that is, when the latch 340 is positioned at the unlatched position, as illustrated in FIG. 25, a large part of a communication hole 329*b*, that is, an opening configured to allow an upper portion of the mounting recessed portion 329 and the striker entry groove 328 to communicate with each other is closed by the latch 340. The communication hole 329*b* is formed in an end of the upper portion, that is, a region located above the striker entry groove 328, of the mounting recessed portion 329 of the first housing 327. In other words, a gap 329*b*1 is defined only in an end of the communication hole 329*b*. Therefore, when the vehicle is washed, there is a fear in that water flows through the gap 329*b*1 toward the through-hole 330 located above the striker entry grooves 328 and 336.

However, the through-hole 330 is located above the striker entry grooves 328 and 336 and the gap 329*b*1. Further, as illustrated in FIG. 23, the latch-side waterproof wall 331 is located between the gap 329*b*1 and the through-hole 330.

Accordingly, when water intrudes into the mounting recessed portion 329 through the gap 329*b*1, the latch-side waterproof wall 331 can effectively prevent the water from flowing to the through-hole 330 side.

Further, as is apparent from FIG. 36 and FIG. 39, the door switch 393 is located above the through-hole 330 of the latch unit 325. Accordingly, even when water intrudes into the actuator unit 350 through the through-hole 330, a risk of causing the water to flow to the door switch 393 side is small.

The present invention is not limited only to the above-mentioned typical embodiments, and various applications and modifications may be made. For example, the following respective embodiments applying the above-mentioned embodiments can be carried out.

Description is made of the case where, in the door lock device 100 or 320 described above, while the latch 112 or 340 is pivoted from the fully-latched position P1 halfway to the unlatched position P4, the portion of the latch 112 or 340 to be engaged with the arm distal end portion 143*a* or 423 of the first engagement arm 143 or 422 of the switch lever 141 or 420 is switched from the first engagement surface 116 or 340*a* of the latch 112 or 340 to the second engagement surface 117 or 340*b* thereof. However, according to the present invention, there may be adopted such a configuration that the arm distal end portion 143*a* or 423 of the first engagement arm 143 or 422 is always engaged with the first engagement surface 116 or 340*a* of the latch 112 or 340 when the pivoting amount of the switch lever 141 or 420 can be reduced while the latch 112 or 340 is pivoted from the fully-latched position P1 halfway to the unlatched position P4.

Each of the door lock devices 100, 200 may be configured such that the actuation state of the door switch 140 is switched from the ON state to the OFF state when each latch 112 is pivoted from the fully-latched position P1 to the switching position (switch-on position) P2 halfway to the unlatched position P4 (the half-latched position P3).

The door lock devices 100, 200, 320 may be arranged on the vehicle body side, and the striker may be arranged on the vehicle door side.

According to the present invention, the essential structure of each of the door lock devices 100, 200, 320 described above is applicable to respective vehicle doors of the vehicle. For example, the essential structure of each of door lock devices 100, 200, 320 according to the present invention is applicable to right and left doors for front seats of the vehicle, right and left doors for rear seats of the vehicle, and a door (back door) arranged at a rear portion of the vehicle. Further, the door, to which each of door lock devices 100, 200, 320 is applied, may be pivoted with respect to the vehicle body not only in the horizontal direction but also in the upward and downward directions.

Components corresponding to the latch housing 326 and the actuator housing 351 may be formed integrally with each other to constitute one housing.

The second waterproof wall 428 may press the pressed projection 395 of the door switch 393 and thus switch the door switch 393 to the ON state when the latch 340 is positioned at the fully-latched position, and the second waterproof wall 428 may separate from the pressed projection 395 of the door switch 393 and thus switch the door switch 393 to the OFF state when the latch 340 is positioned between the switching position P2 and the unlatched position P4.

An electrical component other than the lighting device may be connected to the ECU, and the electrical component may be switched between an ON state and an OFF state in interlock with turning on or off of the door switch 140 or 393.

The entire part of the through-hole 330 and the latch 340 may overlap each other in the frontward and rearward directions when the latch 340 is positioned at the unlatched position.

Further, the first waterproof wall (hole closing side portion) 124 and the second waterproof wall (hole closing side portion) 128 may overlap the entire part of the through-hole 330 in the frontward and rearward directions.

Each of the door switches (switches) 140, 393 may be a switch of a type other than the type to be pressed by each of the switch levers 141, 420. For example, each of the door switches 140, 393 may be such a non-contact type switch that the switch is in an OFF state (or ON state) when a distance from the switch to the switch lever 141 or 420 is larger than a predetermined distance, and that the switch is switched to the ON state (or OFF state) when the distance from the switch to the door switch 140 or 393 is equal to or smaller than the predetermined distance.

The invention claimed is:

1. A vehicle door lock device, comprising:

a latch configured so as to be pivotable about a latch shaft between a fully-latched position where the latch is engaged with a striker, and an unlatched position where the latch is disengaged from the striker;

a locking mechanism configured to set the latch to an unlocked state enabling disengagement from the striker through a door opening operation of a door handle, or to a locked state disabling the disengagement from the striker through the door opening operation of the door handle;

a door switch configured to detect a position of the latch, the door switch having an engagement projection for switching an actuation state of the door switch between an ON state and an OFF state, the door switch arranged in an actuator housing to which the locking mechanism is assembled;

a switch lever configured so as to be pivotable about a lever shaft extending from the actuator housing in a direction intersecting the latch shaft, the switch lever being configured to pivot in interlock with the latch, the switch lever having a first engagement arm extending toward the latch and a second engagement arm extending toward the door switch, wherein an arm distal end portion of the first engagement arm slides on an outer peripheral cam surface formed on an outer peripheral surface of the latch in a first pivot state in which the latch is pivoted within a range of from the fully-latched position to a switching position halfway to the unlatched position, the outer peripheral cam surface is configured to pivot the first engagement arm as the latch is pivoted from the fully-latched position to the switching position, and an arm distal end portion of the second engagement arm engages with the engagement projection of the door switch when the latch is pivoted to the switching position, so that the actuation state of the door switch is switched to one of the ON state and the OFF state, and the arm distal end portion of the first engagement arm slides on one of a pair of side surfaces formed on the latch, which extend along a pivoting plane of the latch, closer to the lever shaft, in a second pivot state in which the latch is pivoted within a range from the switching position to the unlatched position, so that the actuation state of the door switch is kept in the one of the ON state and the OFF state.

2. The vehicle door lock device according to claim 1, wherein the first engagement arm is configured to press the latch toward the fully-latched position, and the first engagement arm is elastically biased by an elastic biasing force of a lever spring in a direction of pressing the latch toward the fully-latched position, the outer peripheral cam surface is formed on the latch so as to keep the ratio of a pivoting amount of the first engagement arm to a pivoting amount of the latch when the arm distal end portion of the first engagement arm slides on the outer peripheral cam surface in the first pivot state against the elastic biasing force of the lever spring; and the one of the pair of side surfaces is formed on the latch so as to lower the ratio of the pivoting amount of the first engagement arm to the pivoting amount of the latch when the arm distal end portion of the first engagement arm slides on the one of the pair of side surfaces in the second pivot state against the elastic biasing force of the lever spring as compared to the ratio in the first pivot state.

3. The vehicle door lock device according to claim 2, wherein the first engagement arm extends toward the latch from a boss portion that is to be mounted to the lever shaft.

4. The vehicle door lock device according to claim 1, further comprising a latch housing having a support wall, which is configured to support the latch so as to enable the latch to pivot and has a through-hole formed therein, wherein the latch is biased to move toward the unlatched position, wherein the switch lever passes through the through-hole in a relatively movable manner, and wherein, when the latch is positioned at the unlatched position, the latch overlaps at least a part of the through-hole as seen from a thickness direction of the support wall.

5. The vehicle door lock device according to claim 4, wherein the actuator housing comprises a switch-side waterproof wall positioned between the through-hole and the door switch.

6. The vehicle door lock device according to claim 4, wherein the latch housing has a striker entry groove and a communication hole formed therein, wherein the striker entry groove receives the striker when the vehicle door is closed, and the communication hole allows the striker entry groove and an internal space of the housing to communicate with each other, wherein the latch opens a part of the communication hole when the latch is positioned at the unlatched position, and wherein the latch housing comprises a latch-side waterproof wall located between the part of the communication hole and the through-hole.

7. The vehicle door lock device according to claim 4, wherein the housing has a striker entry groove that is formed therein and communicates with an internal space of the housing, wherein the striker entry groove receives the striker when the vehicle door is closed, and wherein the door switch is arranged in a region of the internal space of the housing above the striker entry groove.

8. The vehicle door lock device according to claim 1, further comprising a latch housing having a support wall, which is configured to support the latch so as to enable the latch to pivot and has a through-hole formed therein, wherein the latch is biased to move toward the unlatched position, wherein the switch lever passes through the through-hole in a relatively movable manner, and wherein, when the latch is positioned at the unlatched position, the switch lever overlaps at least a part of the through-hole as seen from a thickness direction of the support wall.

9. The vehicle door lock device according to claim 8, wherein the switch lever positioned between the support wall and the door switch presses the door switch.

10. The vehicle door lock device according to claim 8, wherein the actuator housing comprises an inner wall, which is to be positioned between the through-hole and the door switch and has a switch lever movement allowing groove formed therein, wherein the switch lever is arranged in the switch lever movement allowing groove in a relatively movable manner, and wherein the switch lever overlaps at least a part of the switch lever movement allowing groove as seen from a thickness direction of the inner wall.

* * * * *